US007673862B2

(12) United States Patent
Kushida et al.

(10) Patent No.: US 7,673,862 B2
(45) Date of Patent: Mar. 9, 2010

(54) SHEET PROCESSOR AND IMAGE-FORMING APPARATUS

(75) Inventors: Hideki Kushida, Moriya (JP); Yusuke Obuchi, Abiko (JP); Daisaku Kamiya, Abiko (JP); Hitoshi Fujimoto, Abiko (JP); Kiyoshi Watanabe, Kashiwa (JP); Tomokazu Nakamura, Matsudo (JP); Kenichi Hayashi, Abiko (JP); Toshimasa Suzuki, Kashiwa (JP); Atsuteru Oikawa, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/207,443

(22) Filed: Sep. 9, 2008

(65) Prior Publication Data

US 2009/0008856 A1 Jan. 8, 2009

Related U.S. Application Data

(63) Continuation of application No. 11/065,325, filed on Feb. 24, 2005, now Pat. No. 7,431,274.

(30) Foreign Application Priority Data

Feb. 27, 2004 (JP) ..... 2004-055561

(51) Int. Cl.
*B31F 1/10* (2006.01)

(52) U.S. Cl. ..... 270/32; 270/20.1; 270/45; 270/58.07

(58) Field of Classification Search ..... 270/32, 270/58.07, 20.1, 45
See application file for complete search history.

(56) References Cited

U.S. PATENT DOCUMENTS

| | | | | |
|---|---|---|---|---|
| 2,066,620 | A * | 1/1937 | Grammer | 281/27.3 |
| 2,088,904 | A * | 8/1937 | Grammer | 281/15.1 |
| 5,090,672 | A * | 2/1992 | Ballestrazzi et al. | 270/45 |
| 6,692,208 | B1 * | 2/2004 | Watkiss et al. | 412/1 |
| 7,147,598 | B2 * | 12/2006 | Fujimoto et al. | 493/405 |
| 7,285,084 | B2 * | 10/2007 | Fujimoto et al. | 493/442 |
| 7,431,273 | B2 * | 10/2008 | Kamiya et al. | 270/37 |
| 7,431,274 | B2 * | 10/2008 | Kushida et al. | 270/37 |
| 2004/0108642 | A1 * | 6/2004 | Stolz et al. | 270/52.18 |
| 2005/0008460 | A1 * | 1/2005 | Watkiss | 412/9 |

* cited by examiner

*Primary Examiner*—Gene Crawford
*Assistant Examiner*—Leslie A Nicholson, III
(74) *Attorney, Agent, or Firm*—Canon USA Inc., IP Div

(57) ABSTRACT

A sheet processor includes a holding unit for holding a folded batch of sheets, a pressing member for pressing against a folded portion of the batch of sheets, a nipping member for nipping portions of the batch adjacent to the folded portion so as to nip the batch of sheets from opposite directions, and a casing for supporting the pressing member and the nipping member.

10 Claims, 17 Drawing Sheets

SHEET PROCESSOR AND IMAGE-FORMING APPARATUS

CROSS REFERENCE TO RELATED APPLICATIONS

This application is a continuation of U.S. patent application Ser. No. 11/065,325 filed Feb. 14, 2005, which claims priority from Japanese Patent Application No. 2004-055561 filed Feb. 27, 2004. This application is also related to U.S. patent application Ser. No. 11/065,204, entitled "Folded Back Portion Flattening Device, Sheet Processor, and Image Forming Apparatus" filed Feb. 24, 2005, and U.S. patent application Ser. No. 11/066,131, entitled "Sheet Processing Device and Image Formation Apparatus" filed Feb. 24, 2005. All of the applications above are incorporated by reference herein in their entirety.

BACKGROUND OF THE INVENTION

1. Field of the Invention

The present invention relates to a sheet processor for processing a folded portion of a folded batch of sheets, such as a portion equivalent to a spine of a booklet, and to an image-forming apparatus provided with such a sheet processor.

2. Description of the Related Art

Conventionally, stitching/folding devices are used to form booklets by folding back a batch of about 20 or less stacked sheets. In such stitching/folding devices, a batch of sheets may simply be folded back, or may be saddle-stitched before being folded back, or may be bound together using an adhesive (i.e. perfect binding) instead of using thread or staples.

However, as shown in FIG. 15, the folded region of a batch S includes a folded portion Sb (i.e. the spine of a booklet) and its adjacent portions that form a curve and thus bulge. Since this bulging folded region of the batch S has resiliency, when multiple batches S of sheets are stacked one on top of the other, the stack of batches S becomes unstable. This led to difficulties in storing or transferring the stack of batches S.

To solve this problem, Japanese Patent Laid-Open No. 2001-260564 (GB2381237) (corresponding to U.S. Pat. No. 6,692,208), for example, discloses a sheet processor that can flatten the folded region of the batch S including the folded portion Sb so that the folded batch S can be laid flat, as shown in FIG. 16.

FIGS. 17A to 17C and 18 illustrate a conventional sheet processor 901. In the sheet processor 901, a half-folded saddle-stitched batch S of sheets forming a booklet is conveyed to a stopper plate 905 by a conveyor belt 906 in a manner such that the folded portion Sb (the spine) of the batch S is the leading end. Referring to FIG. 17A, the stopper plate 905 is movable in the vertical direction and temporarily receives and stops the batch S conveyed by the conveyor belt 906. Subsequently, referring to FIG. 17B, the batch S is nipped between a pair of gripping members 902 and 903, and the stopper plate 905 is then lifted upward. Here, the folded portion Sb protrudes from the pair of gripping members 902 and 903. The stopper plate 905 moves away from the folded portion Sb. The sheet processor 901 then presses a pressing roller 904 against the folded portion Sb and moves the pressing roller 904 along the folded portion Sb. Thus, the bulging folded portion Sb is pressed by the pressing roller 904 and is made flat, as shown in FIG. 18.

In the conventional sheet processor 901, the gripping members 902 and 903 nip the region of the batch S adjacent to the folded portion Sb entirely along the folded portion Sb before moving the pressing roller 904 to flatten the folded portion Sb.

For this reason, the nipping force of the gripping members 902 and 903 lacks uniformity since the nipping force received by the folded portion Sb is different between the opposite longitudinal end portions of the folded portion Sb and the central portion of the folded portion Sb. Specifically, nipping entirely along the folded portion Sb in the longitudinal direction causes the gripping members 902 and 903 to bend, thus causing the opposite longitudinal end portions of the gripping members 902 and 903 to apply a stronger nipping force than the central portion. Consequently, when the folded portion Sb is being pressed and flattened by a folded-portion flattening unit of the sheet processor 901, a rip or a wrinkle can be formed quite easily at the central portion of the folded portion Sb where the nipping force received is relatively small.

Furthermore, because the gripping members 902 and 903 nip the region of the batch S adjacent to the folded portion Sb entirely along the folded portion Sb according to the sheet processor 901, a loose area in the folded portion Sb, which can be formed when the pressing roller 904 applies pressure to the folded portion Sb, cannot escape. Such a loose area forms a wrinkle in the folded portion Sb, thus leading to a bad appearance of the batch S.

U.S. Pat. Nos. 2,088,904 and 2,066,620 disclose devices for squaring the folded portion of a batch of sheets. Such devices are provided with a first roller for pressing against the folded portion of the batch of sheets, and a pair of second rollers for nipping a region of the batch adjacent to the folded portion. According to the concept of such a structure, the finished result of the processed folded portion of the batch is considered to be dependent on, for example, the positional relationship between the first roller and the second rollers, and the balance of the pressures applied to the batch of sheets from the first and second rollers. However, there are no disclosures in U.S. Pat. Nos. 2,088,904 and 2,066,620 regarding a structure for holding the first and second rollers.

SUMMARY OF THE INVENTION

The present invention provides a sheet processor for properly shaping a folded portion of a folded batch of sheets so as to achieve a fine appearance of the folded portion.

According to an aspect of the present invention, a sheet processor is provided. This sheet processor includes a holding unit configured to hold a folded batch of sheets; a pressing member configured to press against a folded portion of the folded batch of sheets; a nipping member configured to nip portions of the folded batch adjacent to the folded portion so as to nip the batch of sheets from opposite directions; and a casing supporting the pressing member and the nipping member.

According to the sheet processor of the present invention, the nipping member moves while nipping portions adjacent to the folded portion (the spine) of the batch of sheets, and the pressing member follows the nipping member so as to flatten the folded portion disposed between the adjacent portions nipped by the nipping member. Consequently, since the nipping force applied to the batch by the nipping member is substantially constant, the folded portion is prevented from, for example, being torn and wrinkled, which can be seen in the conventional sheet processors due to the lacking of uniformity of the nipping force.

According to another aspect of the present invention, a sheet processor is provided. The sheet processor includes a pushing member configured to push a batch of sheets in a thickness direction of the batch of sheets; a pair of rotatable folding components having a gap therebetween into which the pushing member pushes the batch of sheets, the rotatable folding components receiving and conveying the batch of sheets so as to fold back the batch of sheets; a pressing member configured to press against a folded portion of the folded batch of sheets while the pair of rotatable folding components holds the batch of sheets; a nipping member configured to nip portions of the folded batch of sheets adjacent to the folded portion of the folded batch of sheets so as to nip the folded batch of sheets from opposite directions; and a casing supporting the pressing member and the nipping member.

Further features and advantages of the present invention will become apparent from the following description of exemplary embodiments with reference to the attached drawings.

DESCRIPTION OF THE EMBODIMENTS

Embodiments of a sheet processor and an image-forming apparatus according to the present invention will now be described with reference to the drawings.

Figure 1:
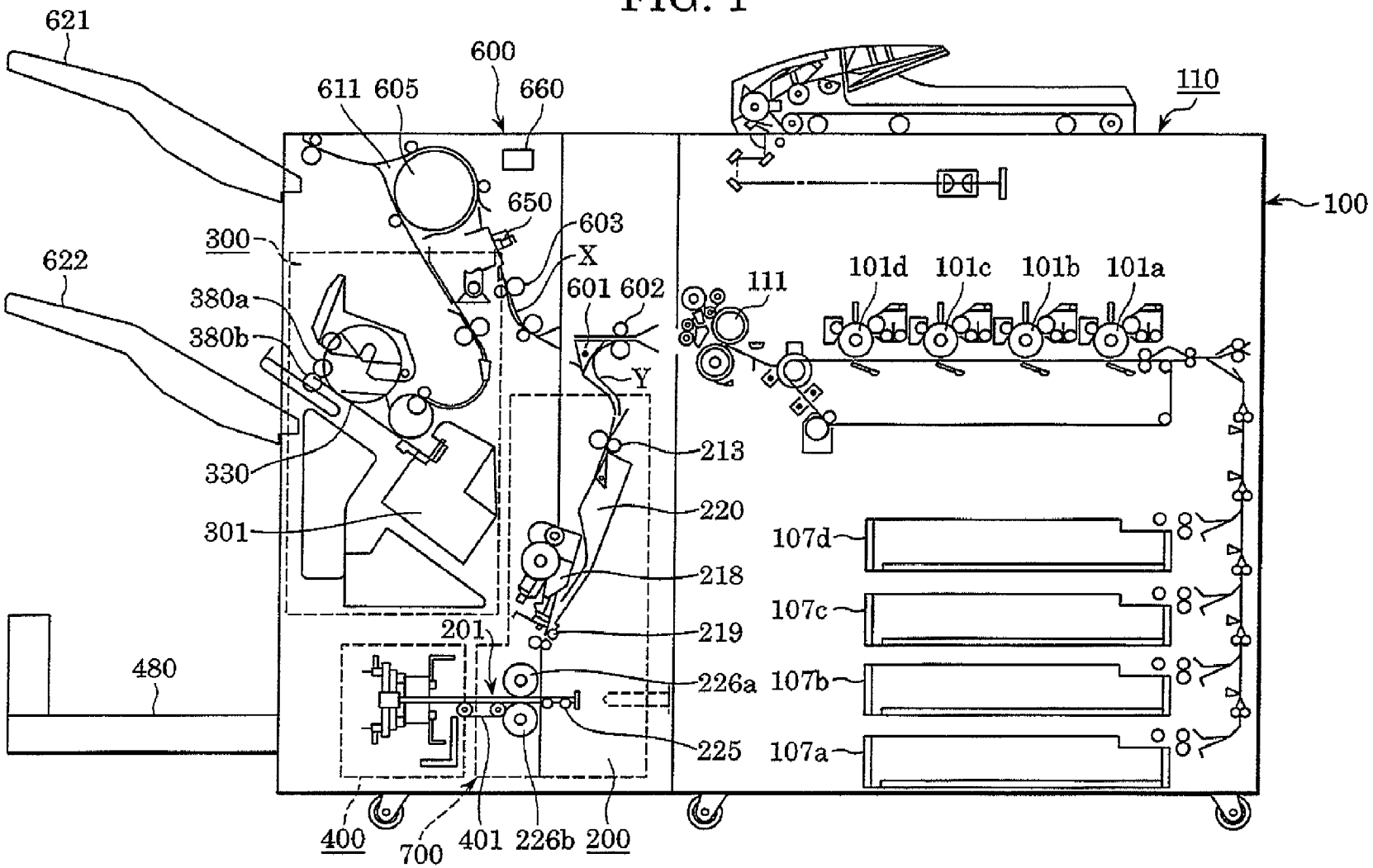
FIG. 1 is a schematic cross-sectional view of a monochrome/color copying apparatus defining an image-forming apparatus according to an embodiment of the present invention.

FIG. 1 illustrates a monochrome/color copying apparatus 110 defining an image-forming apparatus according to the present invention. The copying apparatus 110 includes a main copier 100 and a finisher 600. The finisher 600, which defines a sheet processor according to the present invention, is connected with the main copier 100 and includes a saddle-stitching device 200, a side-stitching device 300, and a folded-portion processing device 400.

The saddle-stitching device 200 and the folded-portion processing device 400 define a saddle-stitch binder 700. The finisher 600 may be used optionally, meaning that the main copier 100 can be used singularly.

Sheets of recording medium supplied from cassettes 107*a* to 107*d* included in the main copier 100 are conveyed to, for example, photoconductive drums 101*a* to 101*d* defining image-forming units. The photoconductive drums 101*a* to 101*d* respectively correspond to four colors, namely, yellow, magenta, cyan, and black. Thus, a toner image including four colors is transferred onto each sheet. Each sheet is then conveyed to a fixing unit 111 where the toner image is fixed on the sheet, and is then discharged outward from the main copier 100.

Each sheet of recording medium discharged outward from the main copier 100 is conveyed toward the finisher 600. The finisher 600 receives the discharged sheets in a sequential manner, and selectively performs the following processes: a packing process for packing the sheets into a single batch in an orderly fashion; a stapling process for stapling together the trailing end of the batch of sheets; a punching process for punching holes near the trailing end of each sheet; a sorting process; a non-sorting process; and a binding process.

The finisher 600 includes a set of entrance rollers 602 for guiding each sheet from the main copier 100 to the interior of the finisher 600. Moreover, a switching flapper 601 is disposed adjacent to the downstream side of the set of entrance rollers 602 and is provided for guiding each sheet towards either a side-stitch binding path X or a saddle-stitch binding path Y.

Each sheet guided to the side-stitch binding path X is conveyed towards a buffer roller 605 via a set of conveyor rollers 603. The set of conveyor rollers 603 and the buffer roller 605 are rotatable in the forward and reverse directions and have a punching unit 650 disposed therebetween. The punching unit 650 punches holes near the trailing end of each sheet, and is operated only when desired.

The buffer roller 605 is capable of taking up multiple sheets of recording medium around the periphery thereof in a multilayer fashion. The multiple sheets taken up by the buffer roller 605 are then conveyed to a switching flapper 611 disposed near the downstream side of the buffer roller 605. The switching flapper 611 allows the batch of multiple sheets to be conveyed either to a sample tray 621 so as to be stacked thereon, or to a processing tray 330 included in the side-stitching device 300 so as to be stacked thereon.

The batch of stacked sheets placed on the processing tray 330 is, for example, aligned in an orderly fashion and side-stitched if desired. The batch is then discharged outward towards a stacking tray 622 via discharging rollers 380*a* and 380*b*. When the side-stitching operation is to be performed on the batch of stacked sheets placed on the processing tray 330, a stapler 301 is used. The stapler 301 binds together an end portion of the batch of sheets, such as a corner.

The operation of the saddle-stitching device 200 will now be described.

Multiple sheets of recording medium guided one by one to the saddle-stitch binding path Y by the switching flapper 601 are conveyed to a storage guide 220 via a set of conveyor rollers 213, and are temporarily stored in the storage guide 220. Each sheet in the storage guide 220 is conveyed until the leading end of the sheet comes into contact with a movable sheet-positioning member (not shown). Moreover, a stapler 218 is disposed at an intermediate position of the storage guide 220. The stapler 218 operates in cooperation with an anvil member 219, which is opposed to the stapler 218, so as to bind the batch of sheets together along the central portion of the batch. In the drawings, reference character Sd indicates each staple fastened to the batch of sheets using the stapler 218.

A set of folding rollers 226*a* and 226*b* is disposed near the downstream side of the stapler 218. Furthermore, a pushing member 225 is disposed at a position where the pushing member 225 is opposed to the set of folding rollers 226*a* and 226*b*. Specifically, although shown differently in FIG. 1, the pushing member 225 is initially set in a manner such that the front edge of the pushing member 225 faces a gap formed between the folding rollers 226*a* and 226*b*. The set of folding rollers 226*a* and 226*b* and the pushing member 225 define a sheet-folding unit 201 for folding back the batch of sheets.

When the batch of sheets bound together by the stapler 218 is to be folded back, the sheet-positioning member (not shown) descends so as to allow the stapled portions of the batch to be horizontally aligned with and opposed to the gap between the folding rollers 226*a* and 226*b*, i.e. the central horizontal line of the set of folding rollers 226*a* and 226*b*. Subsequently, the front edge of the pushing member 225 comes into contact with the batch of sheets and pushes the batch into the gap between the folding rollers 226*a* and 226*b*. Thus, the batch of sheets is conveyed into the gap while being nipped between the folding rollers 226*a* and 226*b*, whereby the batch is folded back. Consequently, the batch of sheets becomes a saddle-stitched booklet. Alternatively, the batch of sheets may be folded back without being saddle-stitched along the central portion.

The pushing member 225 and a binding conveyor-belt 401 then convey the saddle-stitched batch of sheets to the folded-portion processing device 400.

Figure 10:
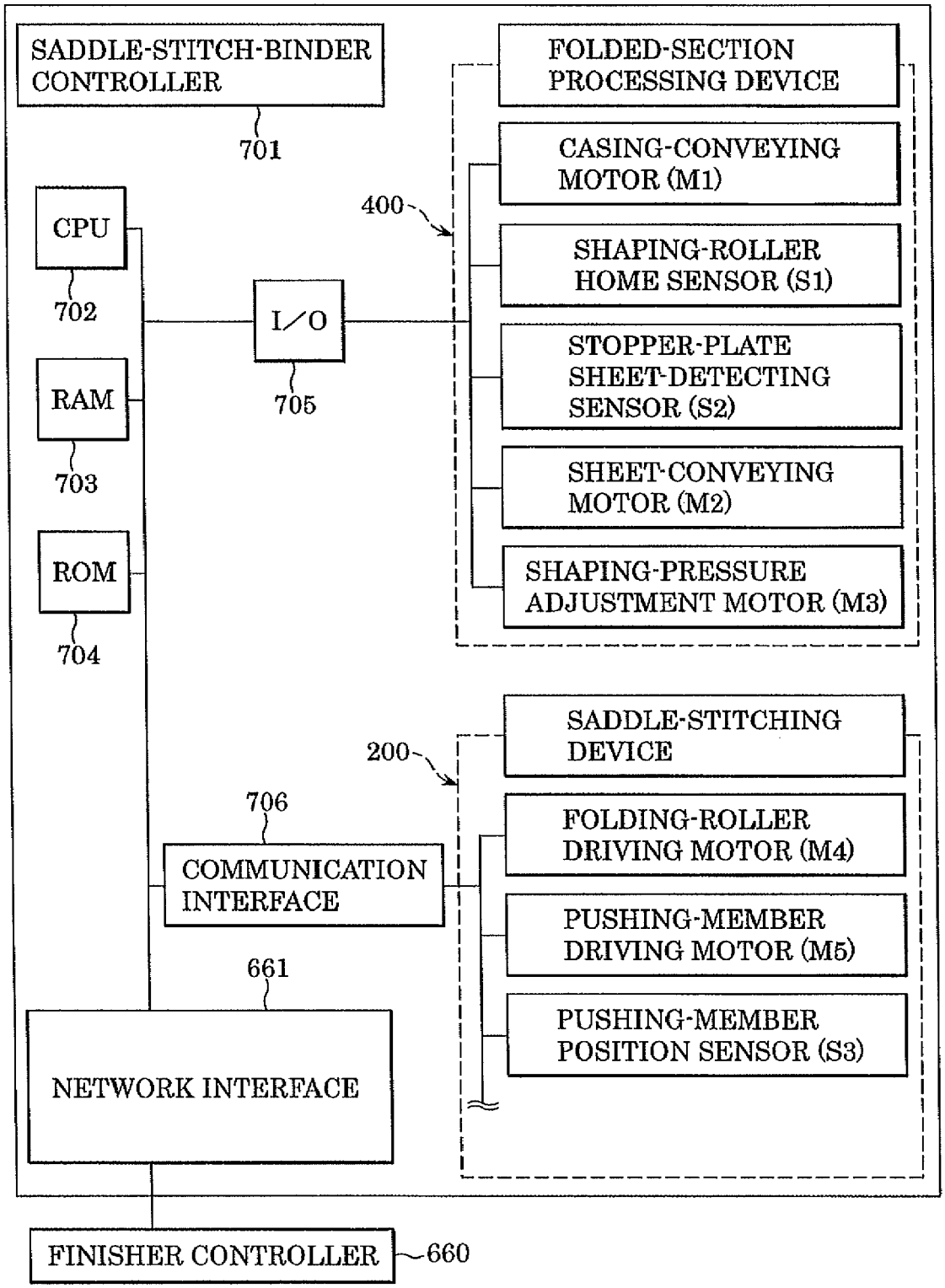
FIG. 10 is a control block diagram including, for example, the folded-portion processing device.

Referring to FIG. 10, a controller 701 included in the finisher 600 is provided for controlling the saddle-stitch binder 700 and includes, for example, a CPU 702, a RAM 703, and a ROM 704 which are connected with a finisher controller 660 via a network interface 661. The finisher controller 660 is for controlling the finisher 600. The CPU 702 sends signals to and receives signals from the finisher controller 660 in order to control the saddle-stitching device 200 or the folded-portion processing device 400. The RAM 703 stores, for example, process data of the folded-portion processing device 400 and the saddle-stitching device 200. The ROM 704 stores, for example, control procedures of the finisher 600. The folded-portion processing device 400 is connected with, for example, the CPU 702 via I/O 705. The saddle-stitching device 200 is connected with, for example, the CPU 702 via a communication interface 706.

Figure 2:
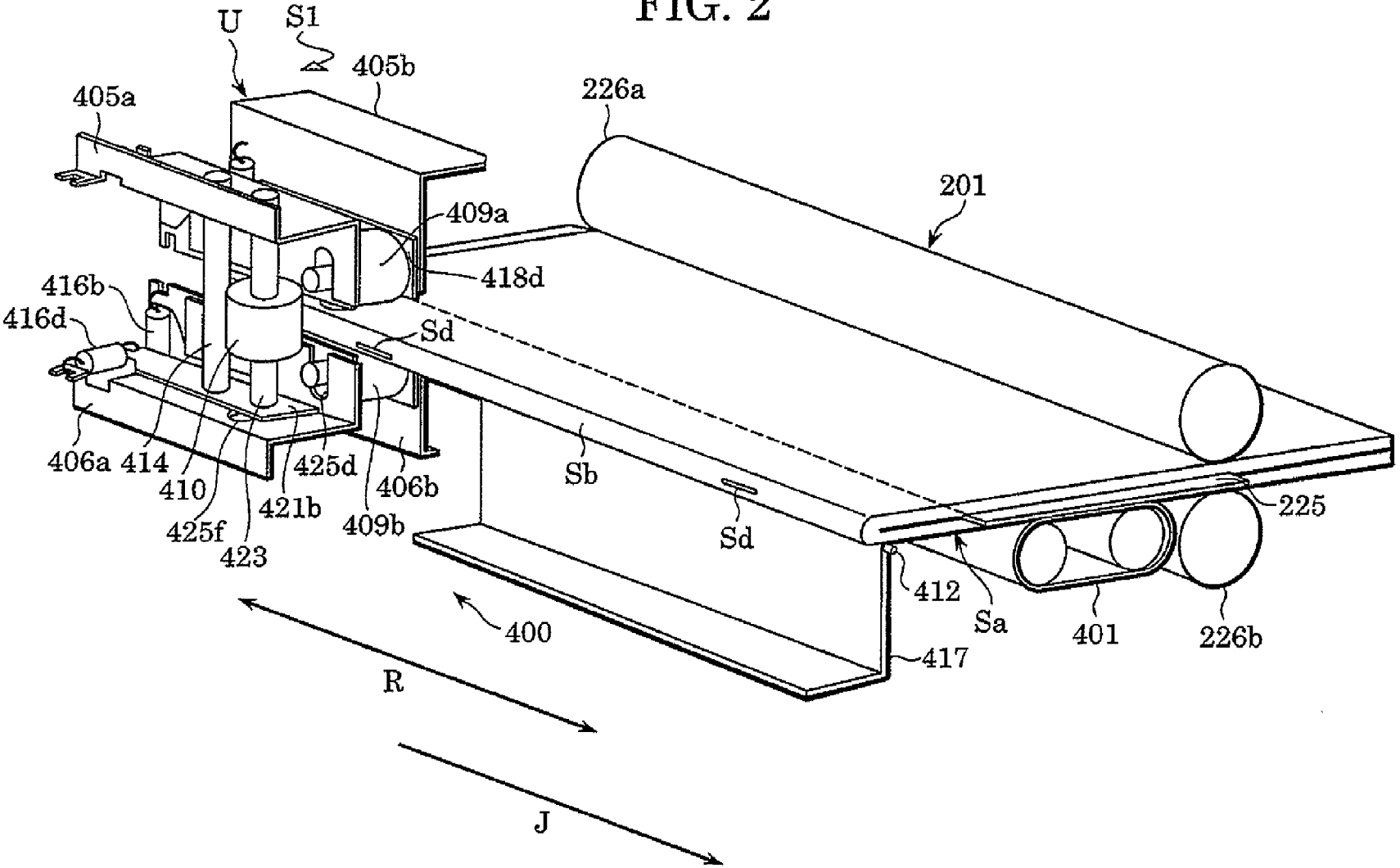
FIG. 2 is a schematic perspective view of a folded-portion processing device included in a sheet processor according to a first embodiment of the present invention.

The structure of the folded-portion processing device 400 according to a first embodiment will now be described with reference to FIGS. 2 to 6. A stopper plate 417 shown in FIG. 2 is provided for positioning the leading end of the folded batch of sheets, i.e. the folded edge of the batch, and is rotatably supported by a rotary shaft 412. The stopper plate 417 is rotatable vertically about the rotary shaft 412 with a driving source (not shown).

Figure 3:
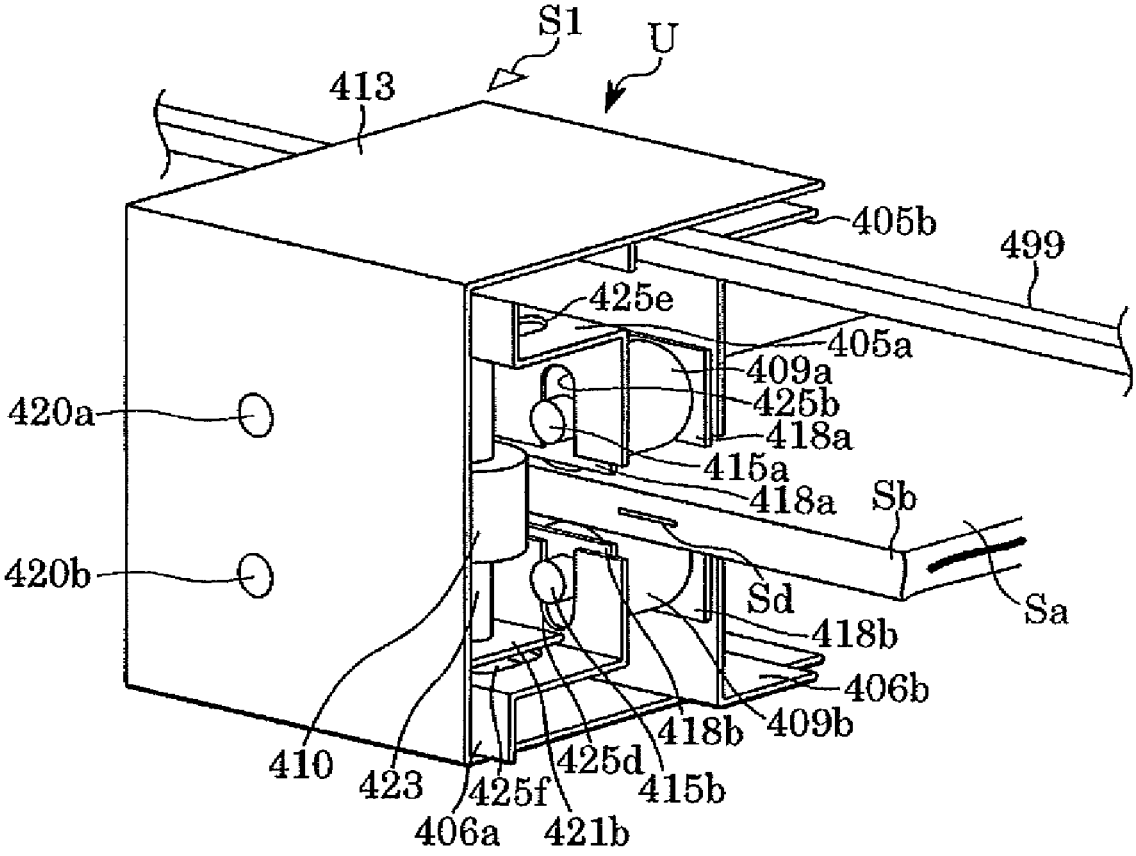
FIG. 3 is a partial perspective view of the folded-portion processing device.
Figure 4:
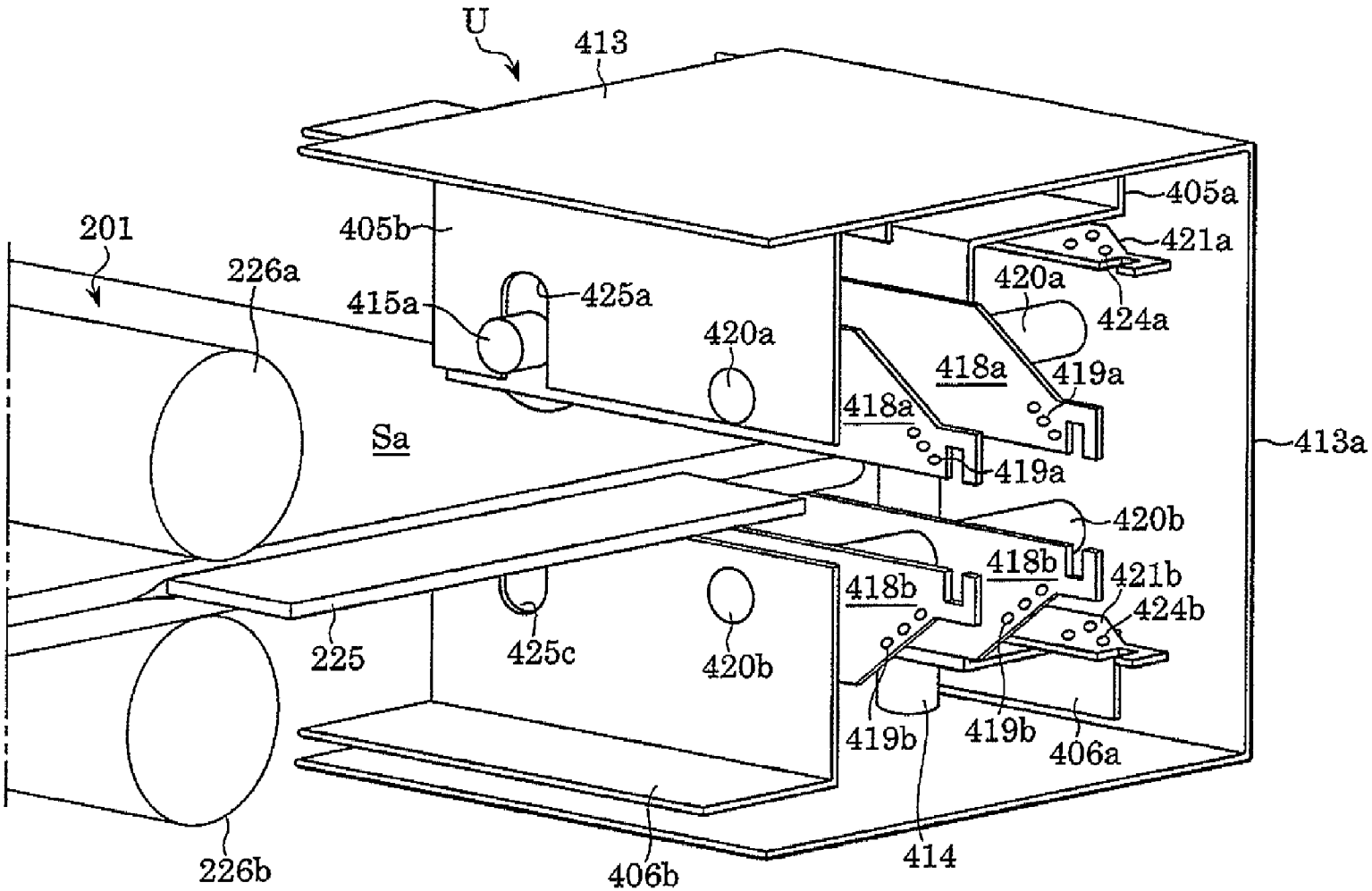
FIG. 4 is a perspective view of the folded-portion processing device as viewed from a side of a batch of sheets.

Referring to FIGS. 3 and 4, a casing 413 having a substantially U-shaped cross section is provided for supporting an upper shaping-gripper 409*a*, a lower shaping-gripper 409*b*, a shaping roller 410, and other related components. In other words, the casing 413 and the above components supported by the casing 413, i.e. the upper shaping-gripper 409*a*, the lower shaping-gripper 409*b*, the shaping roller 410, and other related components, form a single folded-portion processing unit U for processing the folded portion of the batch of sheets. The folded-portion processing unit U receives a driving force of a casing-conveying motor M1, which is shown in FIG. 10 and defines a driving mechanism, via, for example, an endless rotating belt or chain (not shown). The driving force of the casing-conveying motor M1 is transmitted to the folded-portion processing unit U via the rotating belt or chain so as to allow the folded-portion processing unit U to move back and forth in a direction indicated by an arrow R in FIG. 2.

Referring to FIG. 3, a guide rail 499 defining a supporting member is provided. On the other hand, reference characters Sa and Sb respectively indicate the batch of sheets and the folded portion (i.e. the spine) of the batch. The guide rail 499 supports the casing 413 in a slidable manner along the folded portion Sb of the batch Sa.

The shaping roller 410 defines a pressing member for pressing the folded portion Sb (the spine) into a predetermined shape (that is, to flatten the folded portion Sb in the first embodiment). The upper shaping-gripper 409*a*and the lower shaping-gripper 409*b* define a nipping member for applying pressure to portions of the batch Sa adjacent to the folded portion Sb so as to nip the batch Sa from opposite directions.

The casing 413 is illustrated only in FIGS. 3 and 4, and is not shown in the other drawings for the purpose of providing a simple and clear illustration. Furthermore, springs, which will be described later in detail, are not illustrated in FIGS. 3 and 4. Moreover, the guide rail 499 is illustrated only in FIG. 3, and is not shown in the other drawings for the purpose of providing a simple and clear illustration.

Referring to FIGS. 2 to 4, the casing 413 has a pair of upper side plates 405*a* and 405*b* and a pair of lower side plates 406*a* and 406*b* fixed therein. Moreover, a tilting fulcrum shaft 414 for the shaping roller 410 extends vertically between the upper side plate 405*a* and the lower side plate 406*a*. The casing 413 also contains a tilting fulcrum shaft 420*a* provided for the upper shaping-gripper 409*a* and extending substantially horizontally between a side plate 413*a* of the casing 413 and the upper side plate 405*b*. Moreover, a tilting fulcrum shaft 420*b* for the lower shaping-gripper 409*b* extends substantially horizontally between the side plate 413*a* and the lower side plate 406*b*.

Figure 6:
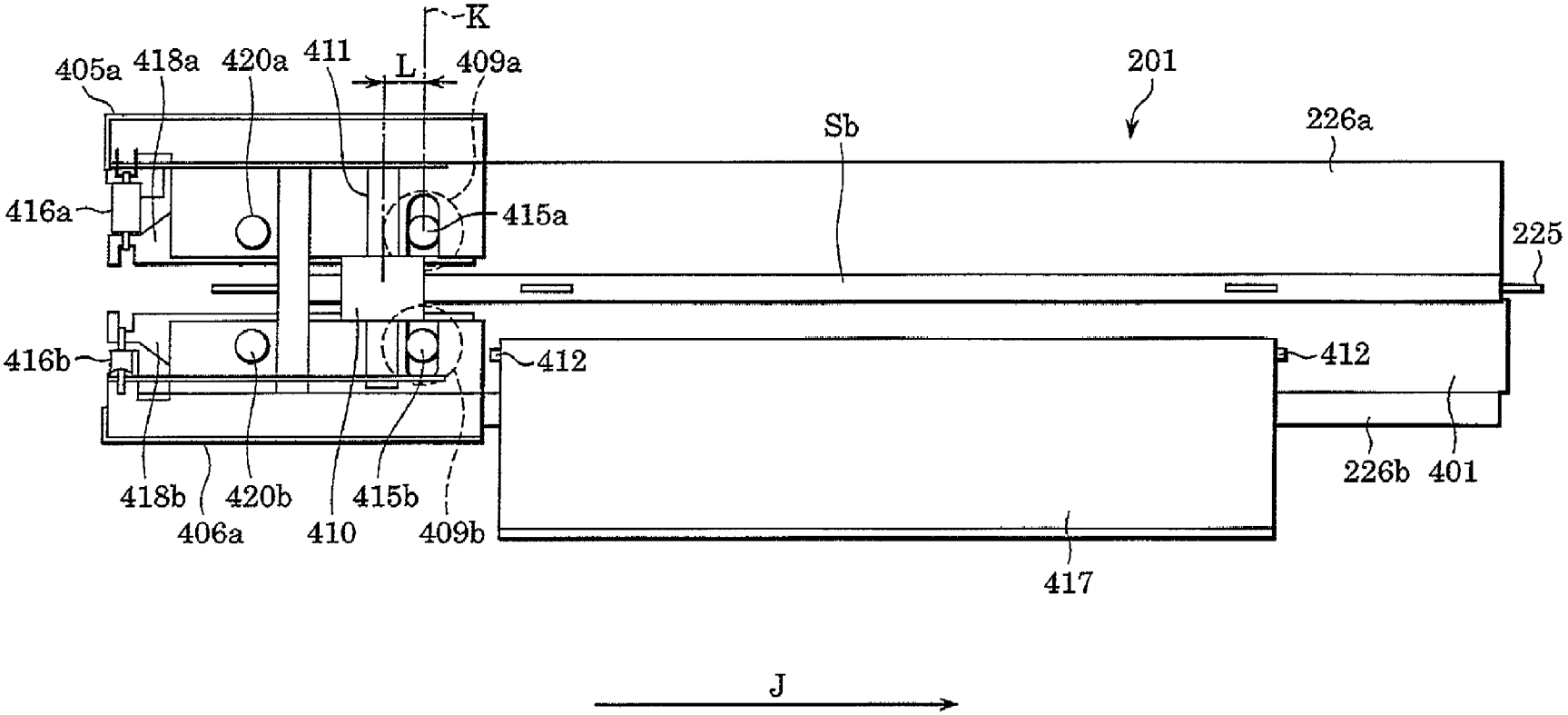
FIG. 6 illustrates a state where a folded portion of the batch of sheets is being flattened by the folded-portion processing device, and is viewed from a side of the folded portion.

Referring to FIGS. 3 and 4, the fulcrum shaft 420*a* for the upper shaping-gripper 409*a* is integrally provided with a pair of pressing arms 418*a* for holding the upper shaping-gripper 409*a*. First end portions of the pressing arms 418*a* support an upper-gripper rotary shaft 415*a* extending substantially horizontally through the upper shaping-gripper 409*a*, such that the pressing arms 418*a* rotatably support the upper shaping-gripper 409*a* via the upper-gripper rotary shaft 415*a*. The upper shaping-gripper 409*a* is a roller. Referring to FIG. 6, the second end portions of the pair of pressing arms 418*a* and the upper side plate 405*a* have an upper-gripper spring 416*a* disposed therebetween for biasing the upper shaping-gripper 409*a*towards the batch Sa. Alternatively, the upper-gripper spring 416*a* may be disposed between the second end portions of the pair of pressing arms 418*a* and a top plate of the casing 413.

Referring to FIGS. 3 and 4, the fulcrum shaft 420*b* for the lower shaping-gripper 409*b* is integrally provided with a pair of pressing arms 418*b* for holding the lower shaping-gripper 409*b*. First end portions of the pressing arms 418*b* support a lower-gripper rotary shaft 415*b* extending substantially horizontally through the lower shaping-gripper 409*b*, such that the pressing arms 418*b* rotatably support the lower shaping-gripper 409*b* via the lower-gripper rotary shaft 415*b*. The lower shaping-gripper 409*b* is a roller. Referring to FIG. 6, the second end portions of the pair of pressing arms 418*b* and the lower side plate 406*a* have a lower-gripper spring 416*b* disposed therebetween for biasing the lower shaping-gripper 409*b* towards the batch Sa. Alternatively, the lower-gripper spring 416*b* may be disposed between the second end portions of the pair of pressing arms 418*b* and a bottom plate of the casing 413.

Accordingly, the pair of pressing arms 418*a* holds the upper shaping-gripper 409*a* and is tiltably supported by the casing 413 via the fulcrum shaft 420*a*. Similarly, the pair of pressing arms 418*b* holds the lower shaping-gripper 409*b* and is tiltably supported by the casing 413 via the fulcrum shaft 420*b*. Consequently, due to the pulling forces of the upper-gripper spring 416*a* and the lower-gripper spring 416*b*, the upper shaping-gripper 409*a* and the lower shaping-gripper 409*b* apply pressure to a top-face portion Sc and a bottom-face portion Se (see FIG. 5) of the batch Sa so as to nip these portions from opposite directions. Specifically, the top-face portion Sc and the bottom-face portion Se are positioned adjacent to and at opposite sides of the folded portion Sb (the spine) of the batch Sa.

The nipping force of the upper shaping-gripper 409*a*and the lower shaping-gripper 409*b* can be adjusted by changing the length of the upper-gripper spring 416*a* and the lower-gripper spring 416*b* (see FIG. 6). In detail, referring to FIG. 4, the pair of pressing arms 418*a* and the pair of pressing arms 418*b* are respectively provided with a plurality of upper nip-adjustment holes 419*a* and a plurality of lower nip-adjustment holes 419*b*, which define a nip-adjustment mechanism. The adjustment can be made by selecting the desired pair of upper nip-adjustment holes 419*a* and the desired pair of lower nip-adjustment holes 419*b* so as to change the hooking positions of the upper-gripper spring 416*a* and the lower-gripper spring 416*b*.

Referring to FIGS. 2 to 6, the two opposite longitudinal ends of the tilting fulcrum shaft 414 extending vertically between the upper side plate 405*a* and the lower side plate 406*a* are respectively joined with an upper pressing arm 421*a* and a lower pressing arm 421*b* provided for the shaping roller 410. First end portions of the upper pressing arm 421*a* and the lower pressing arm 421*b* support a shaping-roller shaft 423 extending vertically through the shaping roller 410, such that the upper pressing arm 421*a* and the lower pressing arm 421*b* rotatably support the shaping roller 410 via the shaping-roller shaft 423. A second end portion of the upper pressing arm 421*a* and the upper side plate 405*a* have an upper shaping-spring 416*c* disposed therebetween. Similarly, a second end portion of the lower pressing arm 421*b* and the lower side plate 406*a* have a lower shaping-spring 416*d* disposed therebetween. The upper-gripper spring 416*a* and the lower-gripper spring 416*b* are provided for biasing the shaping roller 410 against the folded portion Sb of the batch Sa. Alternatively, the upper shaping-spring 416*c* may be disposed between the second end portion of the upper pressing arm 421*a* and the casing 413, and the lower shaping-spring 416*d* may be disposed between the second end portion of the lower pressing arm 421*b* and the casing 413.

Accordingly, the pair of upper pressing arm 421*a* and lower pressing arm 421*b* holds the shaping roller 410 and is tiltably supported by the casing 413 via the fulcrum shaft 414. Consequently, due to the pulling force of the upper shaping-spring 416*c* and the lower shaping-spring 416*d*, the shaping roller 410 applies a pressing force to the folded portion Sb of the batch Sa.

Figure 5:
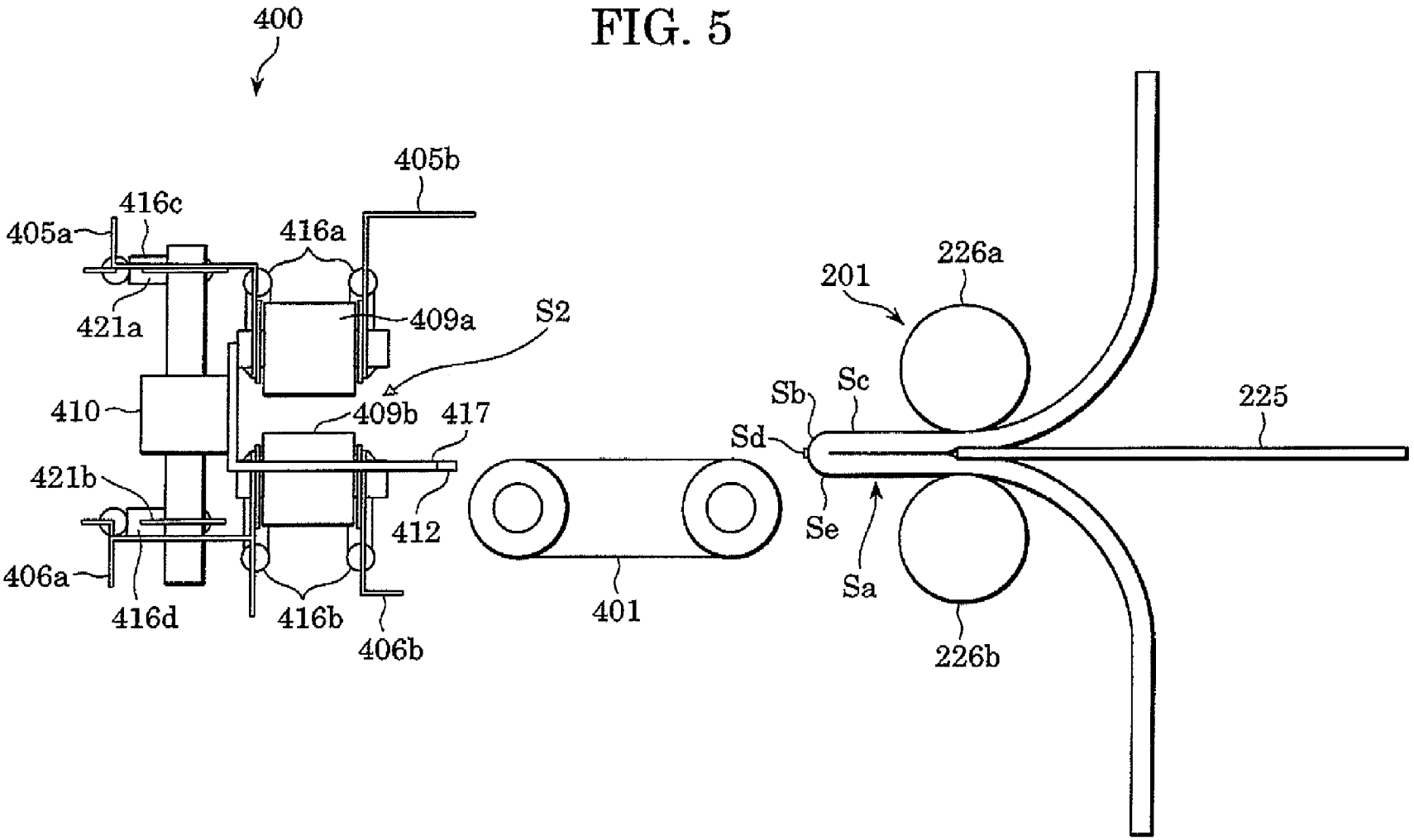
FIG. 5 illustrates a state where the batch of sheets is being folded back by a sheet-folding unit.

The pressing force applied to the folded portion Sb from the shaping roller 410 can be adjusted by changing the length of the upper shaping-spring 416*c* and the lower shaping-spring 416*d* (see FIG. 5). In detail, referring to FIG. 4, the upper pressing arm 421*a* and the lower pressing arm 421*b* are respectively provided with a plurality of upper pressure-adjustment holes 424*a* and a plurality of lower pressure-adjustment holes 424*b*, which define a pressure-adjustment mechanism. The adjustment can be made by selecting the desired one of upper pressure-adjustment holes 424*a* and the desired one of lower pressure-adjustment holes 424*b* so as to change the hooking positions of the upper shaping-spring 416*c* and the lower shaping-spring 416*d*.

In the nip-adjustment mechanism, the nipping force of the upper shaping-gripper 409*a* and the lower shaping-gripper 409*b* is adjusted by selecting a single pair from the multiple pairs of upper nip-adjustment holes 419*a*, and a single pair from the multiple pairs of lower nip-adjustment holes 419*b*. On the other hand, in the pressure-adjustment mechanism, the pressing force of the shaping roller 410 is adjusted by selecting one of the upper pressure-adjustment holes 424*a* and one of the lower pressure-adjustment holes 424*b*. Such adjustments may be made depending on, for example, the number of sheets in a batch, the basic weight of the sheets in a batch, and the types of images formed on the sheets so that the folded portion Sb can be made more precisely flat. Moreover, the adjustments can prevent the folded portion Sb from becoming torn and wrinkled.

For example, if the batch Sa contains a large number of sheets and the basic weight of the sheets is large, or if the occupying percentage of images in the folded portion Sb is high, the expansion stroke of the springs may be set longer so as to increase the nipping force and the pressing force. In contrast, if the batch Sa contains a small number of sheets and the basic weight of the sheets is small, or if the occupying percentage of images in the folded portion Sb is low, the expansion stroke of the springs may be set shorter so as to reduce the nipping force and the pressing force. Accordingly, the folded portion Sb can be made more precisely flat, and moreover, can be prevented from being torn and wrinkled.

Although the nipping force and the pressing force can be adjusted by changing the expansion stroke of the springs in the first embodiment, the adjustments can be made alternatively by simply changing the springs or by changing the arm ratio of the pressing arms. As a further alternative for the nip-adjustment mechanism, the casing 413 may be provided with hooking plates (not shown) at positions on the casing 413 where the upper-gripper spring 416*a* and the lower-gripper spring 416*b* are to be hooked. In this case, the hooking plates may be positionally adjustable so that by shifting the hooking positions of the hooking plates, the length of the upper-gripper spring 416*a* and the lower-gripper spring 416*b* can be adjusted. Consequently, this changes the nipping force. As a further alternative for the pressure-adjustment mechanism, the casing 413 may be provided with hooking plates (not shown) at positions on the casing 413 where the upper shaping-spring 416*c* and the lower shaping-spring 416*d* are to be hooked. In this case, the hooking plates may be positionally adjustable so that by shifting the hooking positions of the hooking plates, the length of the upper shaping-spring 416*c* and the lower shaping-spring 416*d* can be adjusted. Consequently, this changes the pressing force.

Furthermore, although the first embodiment discloses adjustment mechanisms in which the nipping force applied to the batch Sa of sheets from the upper shaping-gripper 409*a* and the lower shaping-gripper 409*b* and the pressing force applied to the batch Sa of sheets from the shaping roller 410 are adjustable by changing the hooking positions of the springs, an alternative mechanism is also permissible, in which the nipping force and the pressing force are adjustable by, for example, changing the positions of first ends of the springs with the use of motors and cam units.

Furthermore, the positional relationship of the contact locations between the batch Sa and the set of upper shaping-gripper 409*a* and lower shaping-gripper 409*b*, and between the batch Sa and the shaping roller 410 may alternatively be adjustable depending on the number of sheets contained in a booklet to be made, the basic weight of the sheets included in the booklet, and the types of images formed on the sheets. In other words, a distance indicated by reference character L in FIG. 6 may be changed.

The upper-gripper rotary shaft 415*a* has its longitudinal ends respectively supported by a pair of arc-shaped slits 425*a* and 425*b* provided in the pair of pressing arms 418*a*; the lower-gripper rotary shaft 415*b* has its longitudinal ends respectively supported by a pair of arc-shaped slits 425*c* and 425*d* provided in the pair of pressing arms 418*b*; and the shaping-roller shaft 423 has its longitudinal ends respectively supported by a pair of arc-shaped slits 425*e* and 425*f* provided in the pair of pressing arms 421*a* and 421*b*. Thus, the upper-gripper rotary shaft 415*a*, the lower-gripper rotary shaft 415*b*, and the shaping-roller shaft 423 are movable in an arc manner. When the pair of pressing arms 418*a*, the pair of pressing arms 418*b*, and the pair of upper pressing arm 421*a* and lower pressing arm 421*b* are not used, these arms are respectively pulled by the upper-gripper spring 416*a*, the lower-gripper spring 416*b*, and the pair of upper shaping-spring 416*c* and lower shaping-spring 416*d*, and are set at their initial positions by corresponding stoppers (not shown) while being restricted from rotating.

The upper and lower shaping-grippers 409*a* and 409*b*, the upper and lower pressing arms 418*a* and 418*b*, the upper and lower gripper springs 416*a* and 416*b*, and other related components define a sheet-nipping unit. On the other hand, the shaping roller 410, the upper and lower pressing arms 421*a* and 421*b*, the upper and lower shaping-springs 416*c* and 416*d*, and other related components define a folded-portion flattening unit.

Referring to FIG. 6, the contact location between the batch Sa and the pair of upper shaping-gripper 409*a* and lower shaping-gripper 409*b* is positioned ahead of the contact location between the batch Sa and the shaping roller 410 by the distance L in a direction indicated by an arrow J. In detail, the direction of the arrow J indicates a moving direction of the shaping roller 410 for flattening the folded portion Sb (the spine) of the batch Sa. On the other hand, the shaping roller 410 does not necessarily need to be disposed behind the upper and lower shaping-grippers 409*a*and 409*b* by the distance L, and may alternatively be aligned with the upper and lower shaping-grippers 409*a* and 409*b* in the direction of the arrow J.

In the structure described above, the casing-conveying motor M1 shown in FIG. 10 moves the casing 413. A home sensor S1 for the shaping roller 410 is provided at a position shown in FIGS. 2 and 3. The home sensor S1 detects whether the shaping roller 410 is at a home position via the casing 413. A sheet-detecting sensor S2 of the stopper plate 417 is provided at a position shown in FIG. 5. The sheet-detecting sensor S2 detects the leading end of the batch Sa of sheets received by the stopper plate 417. Moreover, a sheet-conveying motor M2 is provided for driving the binding conveyor-belt 401.

A shaping-pressure adjustment motor M3 may be provided for adjusting the pressing force of the shaping roller 410 applied to the folded portion Sb. However, if the adjustment of the pressing force of the shaping roller 410 applied to the folded portion Sb of the batch Sa is to be made based on the hooking positions of the springs, the shaping-pressure adjustment motor M3 is not necessary. On the other hand, the saddle-stitching device 200 is provided with a folding-roller driving motor M4 for rotating the set of folding rollers 226*a* and 226*b*. A pushing-member driving motor M5 is also provided for moving the pushing member 225 in a back-and-forth manner. A pushing-member position sensor S3 is disposed at a position shown in FIG. 7C and detects the pushing member 225 when the pushing member 225 is at the most protruding position.

Figure 7A:
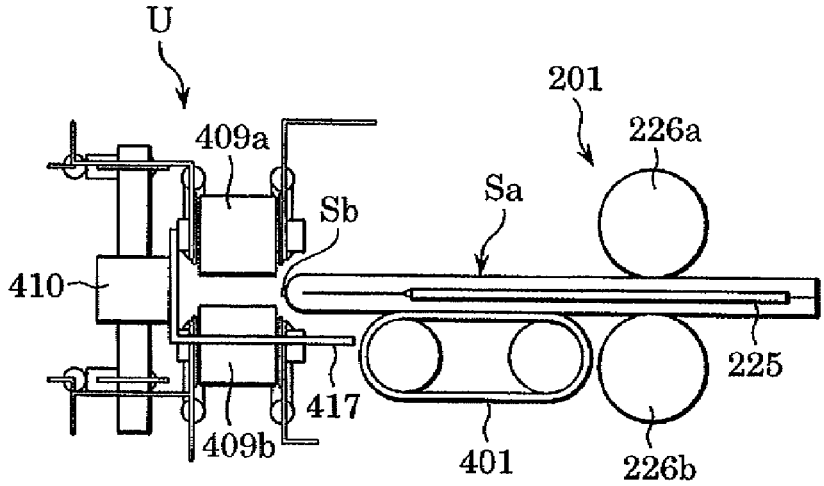
FIG. 7A illustrates one of the steps in the operation of the folded-portion processing device, and shows a state where the batch of sheets is being received by the folded-portion processing device.

The operation of the folded-portion processing device 400 according to the first embodiment will now be described. Although the upper shaping-gripper 409*a* and the lower shaping-gripper 409*b* abut each other when the batch Sa is not nipped therebetween, FIGS. 5 and 7A to 7C illustrate a state where the two grippers 409*a* and 409*b* are positioned distant from each other for the purpose of providing a clear illustration. Referring to FIG. 7A, the batch Sa of sheets folded back by the set of folding rollers 226*a* and 226*b* and the pushing member 225 is conveyed towards the stopper plate 417 with the set of folding rollers 226*a* and 226*b*, the pushing member 225, and the binding conveyor-belt 401. In this case, referring to FIG. 6, a nipping line K extending vertically through the center of the pair of upper shaping-gripper 409*a* and lower shaping-gripper 409*b* is positioned in front of a first edge of the batch Sa.

Figure 7B:
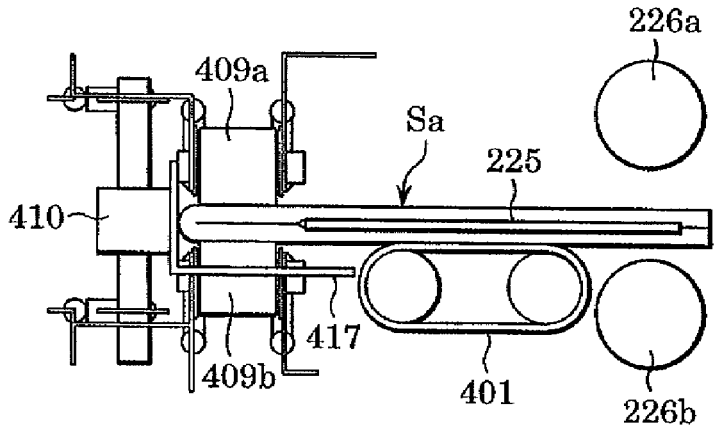
FIG. 7B illustrates another one of the steps in the operation of the folded-portion processing device, and shows a state where the batch of sheets is received and stopped by a stopper plate.
Figure 7C:
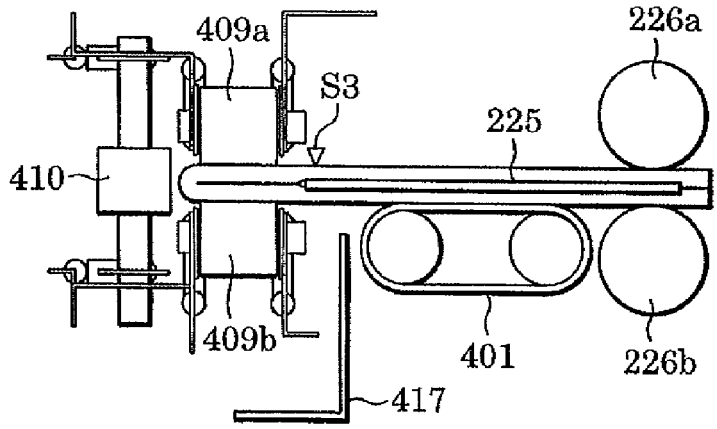
FIG. 7C illustrates another one of the steps in the operation of the folded-portion processing device, and shows a withdrawn state of the stopper plate.

Referring to FIG. 7B, the folding rollers 226*a* and 226*b* are shifted away from the batch Sa before the folded portion Sb of the batch Sa comes into contact with the stopper plate 417. The binding conveyor-belt 401 then conveys the batch Sa until the batch Sa abuts the stopper plate 417. After the leading end of the batch Sa in the conveying direction (i.e. the folded portion Sb) abuts the stopper plate 417, the tilt angle of the leading end portion of the batch Sa is corrected. Referring to FIG. 7C, the stopper plate 417 is then shifted downward.

Figure 8A:
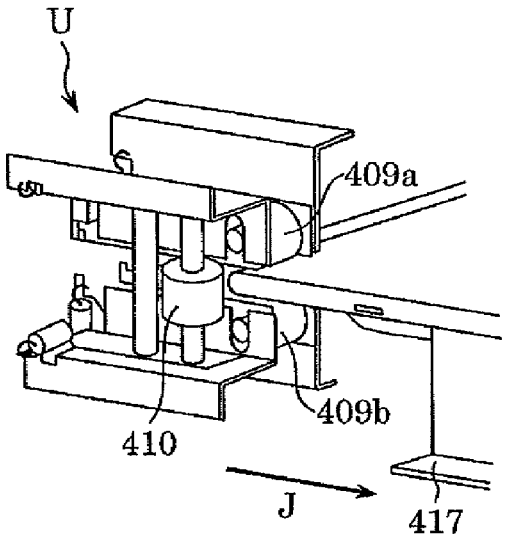
FIG. 8A is a perspective view illustrating another one of the steps in the operation of the folded-portion processing device, and shows a state where a flattening operation for flattening the folded portion is being started.
Figure 8B:
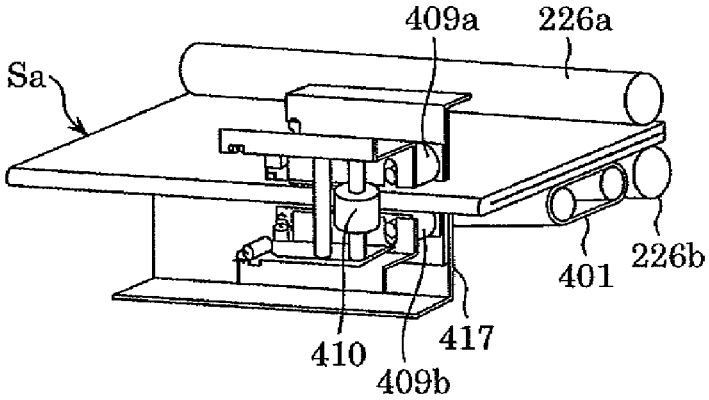
FIG. 8B is a perspective view illustrating another one of the steps in the operation of the folded-portion processing device, and shows a state where the folded portion of the batch of sheets is being flattened.

Referring to FIGS. 8A and 8B, after the leading end portion of the batch Sa is correctly positioned, the folded-portion processing unit U starts to move in the direction of the arrow J. The upper shaping-gripper 409*a* and the lower shaping-gripper 409*b* then begin to nip the top-face portion Sc and bottom-face portion Se adjacent to the folded portion Sb of the batch Sa. Following the upper shaping-gripper 409*a* and the lower shaping-gripper 409*b*, the shaping roller 410 disposed behind the grippers 409*a* and 409*b* by the distance L (see FIG. 4) starts to press against the folded portion Sb of the batch Sa so as to flatten the folded portion Sb.

In the first embodiment, because the batch Sa is held in place by the binding conveyor-belt 401, the pushing member 225, and the set of folding rollers 226*a* and 226*b* when the folded portion Sb of the batch Sa is being flattened by the folded-portion processing device 400, the batch Sa is prevented from being dislocated by being pulled by the folded-portion processing device 400. The binding conveyor-belt 401 (or the pushing member 225) and the set of folding rollers 226*a* and 226*b* define a holding unit for holding the batch Sa in place when the folded portion Sb of the batch Sa is being processed by the folded-portion processing unit U.

Figure 8C:
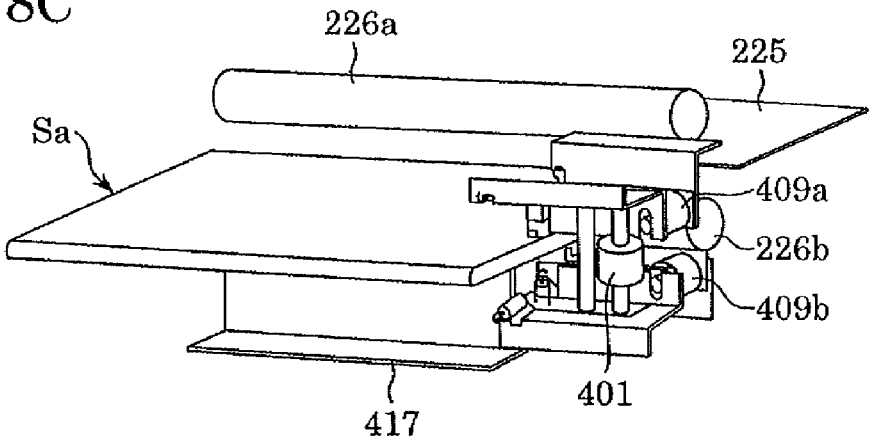
FIG. 8C is a perspective view illustrating another one of the steps in the operation of the folded-portion processing device, and shows a state where the flattening operation of the folded portion is completed and the batch of sheets is being discharged.

When the folded-portion processing unit U reaches a second edge of the batch Sa, the flattening operation for the folded portion Sb is completed. Subsequently, referring to FIG. 8C, the folding rollers 226*a* and 226*b* are shifted away from the batch Sa again. Moreover, the pushing member 225, which previously had been supporting the batch Sa during the flattening operation by the folded-portion processing unit U in order to prevent the batch Sa from hanging downward, is shifted away to a position behind the set of folding rollers 226*a* and 226*b* so as to prepare for the subsequent operation to be performed on the next saddle-stitched batch Sa of sheets. On the other hand, the batch Sa with the flattened folded portion Sb is discharged towards a catch tray 480, which is where multiple batches Sa (booklets) can be stacked one on top of the other.

Figure 9:
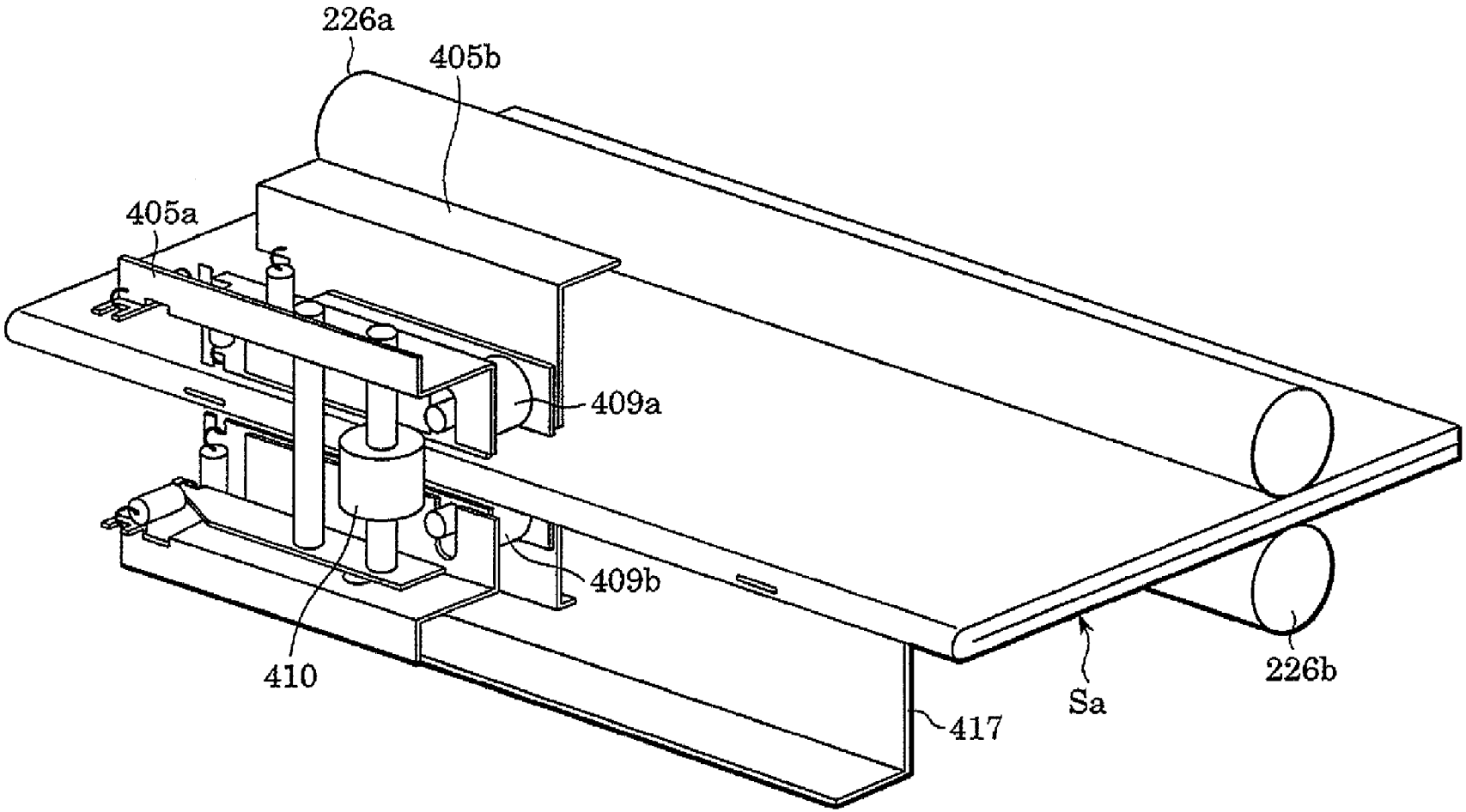
FIG. 9 is a perspective view illustrating an alternative example of the folded-portion processing device according to the first embodiment.

Referring to FIG. 9, the pushing member 225 does not necessarily have to be used for supporting the batch Sa. The batch Sa may alternatively be held in place only by the nipping force of the set of folding rollers 226*a* and 226*b*. Furthermore, a pair of conveyor rollers may simply be used in place of the set of folding rollers 226*a* and 226*b*.

Figure 18:
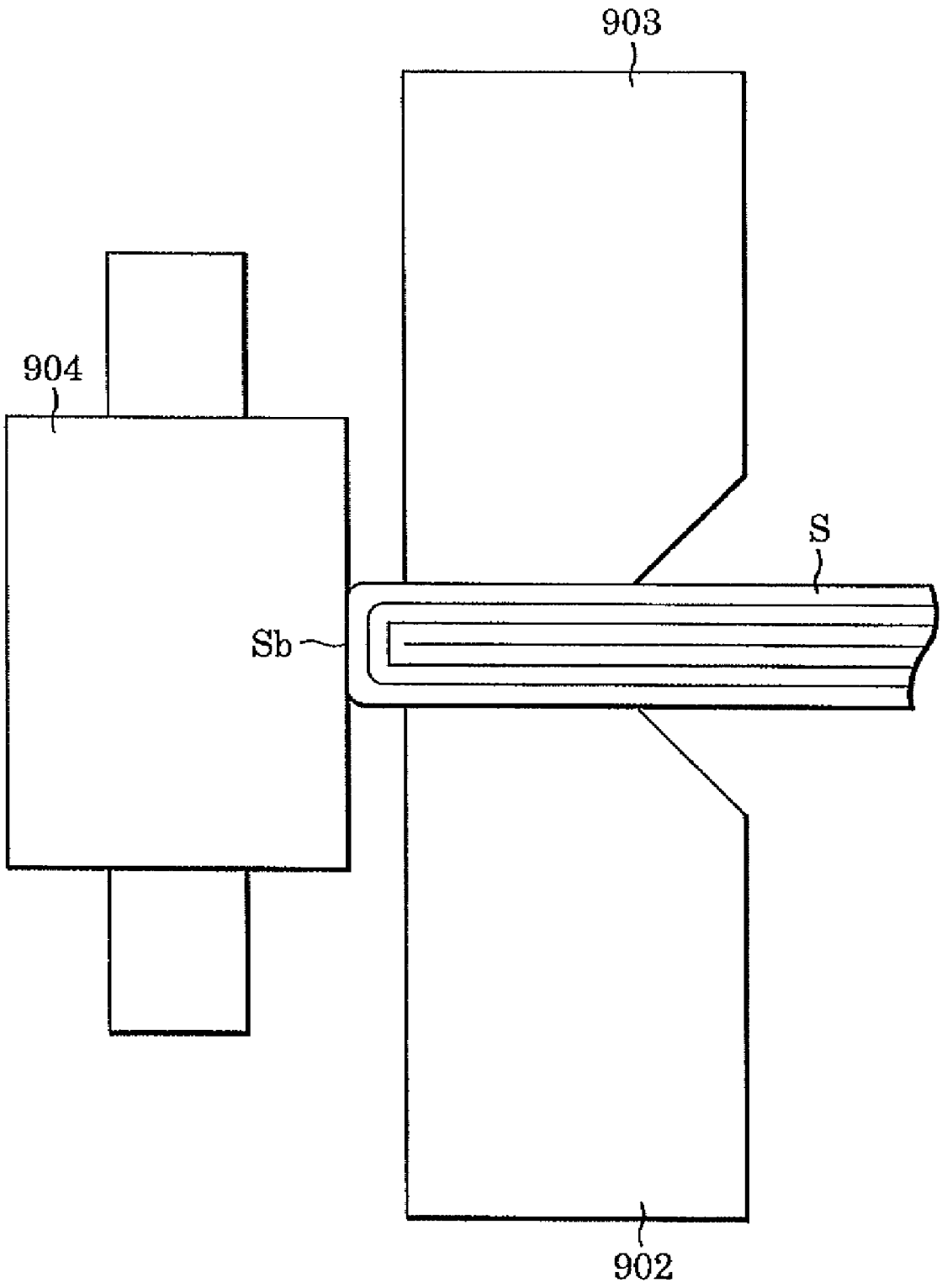
FIG. 18 PRIOR ART
FIG. 18 is an enlarged view of the folded portion of the batch of sheets shown in FIG. 17A.

Because the folded-portion processing device 400 according to the first embodiment applies the folding rollers 226*a* and 226*b* and the pushing member 225 of the sheet-folding unit 201 as a mechanism for holding the batch Sa while the folded portion Sb of the batch Sa is being flattened, the gripping members 902 and 903 shown in FIG. 18 are not necessary. This contributes to a compact and simplified structure as well as achieving lower costs.

Furthermore, in the folded-portion processing device 400 according to the first embodiment, the upper and lower shaping-grippers 409*a* and 409*b* move while nipping the top-face portion Sc and the bottom-face portion Se adjacent to the folded portion Sb, and the shaping roller 410 follows the upper and lower shaping-grippers 409*a* and 409*b* so as to flatten the folded portion Sb disposed between the top-face portion Sc and the bottom-face portion Se nipped by the upper and lower shaping-grippers 409*a* and 409*b*. Consequently, since the nipping force applied to the batch Sa from the upper and lower shaping-grippers 409*a* and 409*b* can be made substantially constant, the folded portion Sb (the spine) being flattened by the shaping roller 410 is prevented from, for example, being torn and wrinkled, which can be seen in the structure including the gripping members 902 and 903 due to the lacking of uniformity in the nipping force of the two gripping members 902 and 903.

Furthermore, in the folded-portion processing device 400 according to the first embodiment, forces are applied to the batch Sa from three directions to partially hold the batch Sa at three portions, namely, the folded portion Sb of the batch Sa, and the top-face portion Sc and bottom-face portion Se adjacent to the folded portion Sb. This reduces, for example, rips and wrinkles in the folded portion Sb and allows an easy flattening operation of the folded portion Sb. Moreover, holding the batch Sa at three portions allows loose areas in the folded portion Sb to escape so that these loose areas are prevented from forming wrinkles in the folded portion Sb. This prevents bad appearance of the batch Sa and is advantageous in comparison with the structure shown in FIG. 18 in which the loose areas cannot escape since the gripping members 902 and 903 extend entirely along the folded portion Sb.

Furthermore, in the folded-portion processing device 400 according to the first embodiment, the shaping roller 410 is disposed behind the upper and lower shaping-grippers 409*a* and 409*b* by the distance L (see FIG. 6) such that the shaping roller 410 follows the upper and lower shaping-grippers 409*a* and 409*b* during the flattening operation. Thus, the top-face portion Sc and the bottom-face portion Se are preliminarily nipped by the upper and lower shaping-grippers 409*a* and 409*b* before the folded portion Sb is flattened by the shaping roller 410. This achieves an easy flattening operation of the folded portion Sb.

Furthermore, in the folded-portion processing device 400 according to the first embodiment, the casing 413 supports the upper shaping-gripper 409*a*, the lower shaping-gripper 409*b*, the shaping roller 410, and other related components to form the folded-portion processing unit U, which is moved with the belt or chain (not shown) rotated by the casing-conveying motor M1 shown in FIG. 10. Moreover, the upper shaping-gripper 409*a*, the lower shaping-gripper 409*b*, and the shaping roller 410 nip and/or press the batch Sa of sheets in response to the springs. Consequently, only one driving unit (the casing-conveying motor M1) is necessary instead of two, that is, first driving unit for vertically moving nipping means provided for nipping the batch Sa and second driving unit for moving shaping means provided for pressing and flattening the folded portion Sb. Accordingly, a more simplified structure is achieved.

The folded-portion processing device 400 according to the first embodiment described above is advantageous in view of, for example, its compactness, its capability of preventing rips and wrinkles from being formed in a folded portion of a batch of sheets (i.e. better functionality), and a less number of components (i.e. a less number of driving units).

Figure 11:
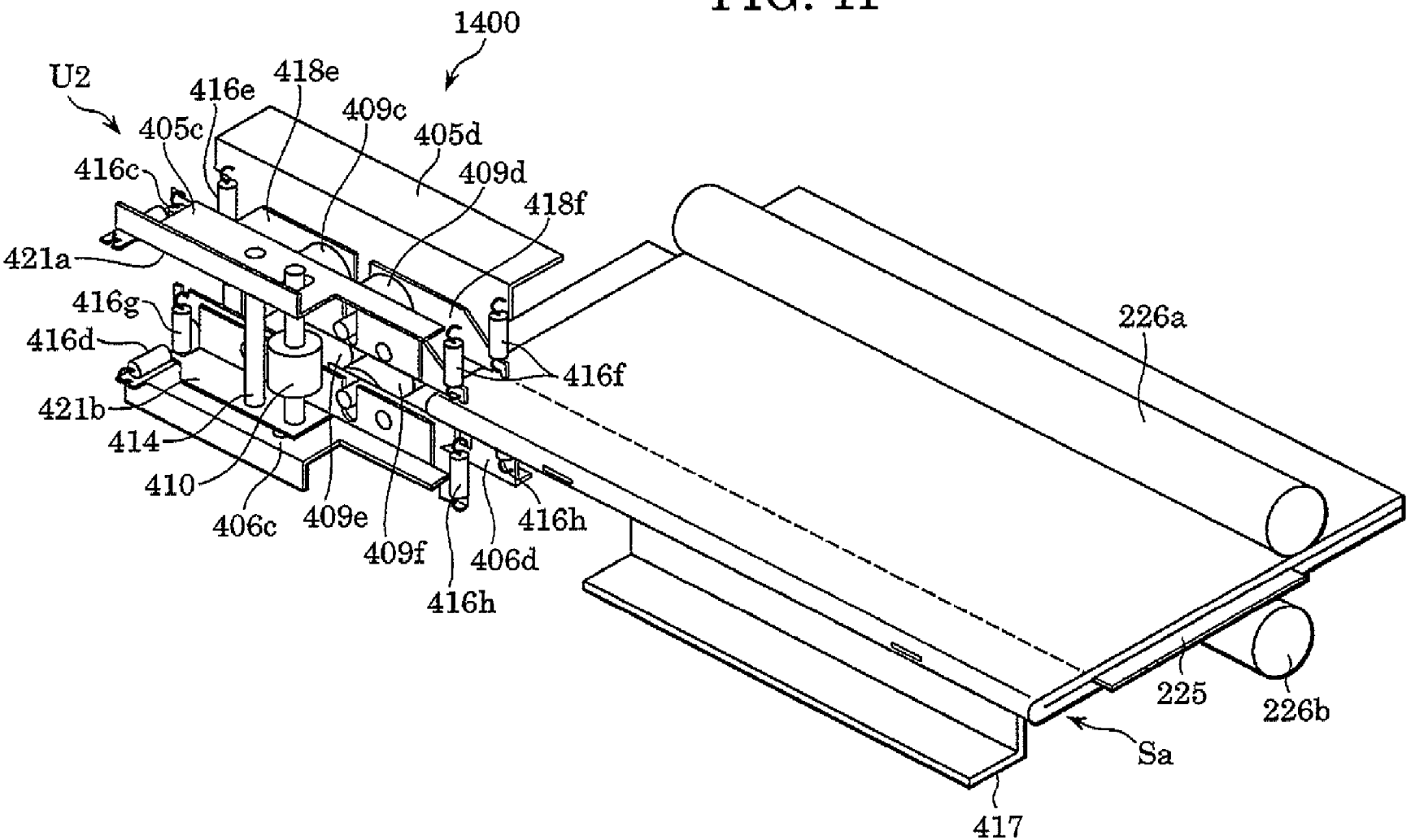
FIG. 11 is a schematic perspective view of a folded-portion processing device according to a second embodiment.
Figure 12:
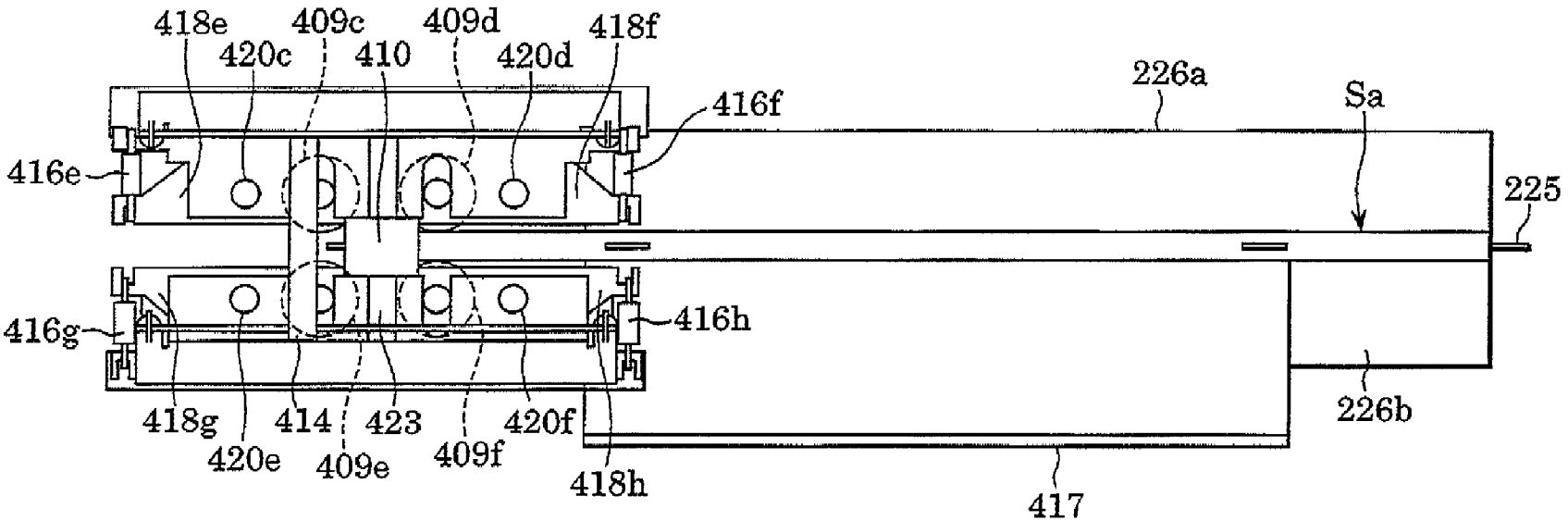
FIG. 12 illustrates a state where the folded portion of the batch of sheets is being flattened by the folded-portion processing device shown in FIG. 11, and is viewed from the side of the folded portion.

FIGS. 11 and 12 illustrate a folded-portion processing device 1400 according to a second embodiment. The folded-portion processing device 1400 is characterized in having a structure in which two folded-portion processing devices 400 according to the first embodiment are disposed in a symmetrical manner with respect to the shaping roller 410 as the center. Specifically, the folded-portion processing device 1400 includes a shaping roller 410, upper shaping-grippers 409*c* and 409*d*, and lower shaping-grippers 409*e* and 409*f*. A set of upper shaping-gripper 409*c* and lower shaping-gripper 409*e* and a set of upper shaping-gripper 409*d* and lower shaping-gripper 409*f* are disposed at opposite sides of the shaping roller 410. The casing 413 provided in the folded-portion processing device 1400 is not shown in FIGS. 11 and 12. Components equivalent to those in the first embodiment are indicated by the same reference numerals, and descriptions of those components will thus be omitted.

The upper shaping-grippers 409*c* and 409*d* are respectively held by pressing arms 418*e* and 418*f*, and the lower shaping-grippers 409*e* and 409*f* are respectively held by pressing arms 418*g* and 418*h*. The pressing arms 418*e* and 418*f* are respectively provided with fulcrum shafts 420*c* and 420*d* for the upper shaping-grippers 409*c* and 409*d*, such that the pressing arms 418*e* and 418*f* are respectively tiltable about the fulcrum shafts 420*c* and 420*d*. On the other hand, the pressing arms 418*g* and 418*h* are respectively provided with fulcrum shafts 420*e* and 420*f* for the lower shaping-grippers 409*e* and 409*f*, such that the pressing arms 418*g* and 418*h* are respectively tiltable about the fulcrum shafts 420*e* and 420*f*. Furthermore, upper-gripper springs 416*e* and 416*f* are provided between first ends of the pressing arms 418*e* and 418*f* and upper side plates 405*c* and 405*d*, and moreover, lower-gripper springs 416*g* and 416*h* are provided between first ends of the pressing arms 418*g* and 418*h* and lower side plates 406*c* and 406*d*. Alternatively, the upper-gripper springs 416*e* and 416*f* may respectively be disposed between the first ends of the pressing arms 418*e* and 418*f* and a top plate of the casing 413 (not shown), and the lower-gripper springs 416*g* and 416*h* may respectively be disposed between the first ends of the pressing arms 418*g* and 418*h* and a bottom plate of the casing 413. Accordingly, due to the spring forces of the upper-gripper springs 416*e* and 416*f* and the lower-gripper springs 416*g* and 416*h*, the set of upper shaping-grippers 409*c* and 409*d* and the set of lower shaping-grippers 409*e* and 409*f* nip the batch Sa.

The shaping roller 410 according to the second embodiment is the same as that of the first embodiment and is used for applying a pressing force to the bulging folded portion Sb of the batch Sa in order to flatten the folded portion Sb. Similar to the first embodiment, the shaping-roller shaft 423 extends vertically through the shaping roller 410 and has two opposite longitudinal ends respectively joined with the upper pressing arm 421*a* and the lower pressing arm 421*b*. The upper pressing arm 421*a* and the lower pressing arm 421*b* are tiltably supported by the fulcrum shaft 414 such that the two pressing arms 421*a* and 421*b* are tiltable concurrently with each other. A first end of the upper pressing arm 421*a* and the casing 413 have the upper shaping-spring 416*c* disposed therebetween, and a first end of the lower pressing arm 421*b* and the casing 413 have the lower shaping-spring 416*d* disposed therebetween. Due to the spring force of these springs 416*c* and 416*d*, the shaping roller 410 presses against the folded portion Sb of the batch Sa so as to flatten the folded portion Sb.

Thus, the upper shaping-grippers 409*c* and 409*d*, the lower shaping-grippers 409*e* and 409*f*, and the shaping roller 410 are disposed between the upper side plates 405*c* and 405*d* and the lower side plates 406*c* and 406*d* included in the casing 413 (not shown) in a rotatable manner. The shaping roller 410 comes into contact with the batch Sa at a position between a first contact location (that is, between the batch Sa and the set of upper shaping-gripper 409*d* and lower shaping-gripper 409*f*) and a second contact location (that is, between the batch Sa and the set of upper shaping-gripper 409*c* and lower shaping-gripper 409*e*).

Accordingly, in addition to the structure of the folded-portion processing device 400 according to the first embodiment, the folded-portion processing device 1400 according to the second embodiment is provided with an additional set of shaping grippers 409*c* and 409*e* disposed behind the shaping roller 410 with respect to the moving direction of the shaping roller 410. The folded-portion processing device 1400 operates substantially in the same manner as the folded-portion processing device 400 according to the first embodiment, and therefore, the description of the operation will be omitted.

In addition to the advantages of the folded-portion processing device 400 according to the first embodiment, the folded-portion processing device 1400 according to the second embodiment achieves an easier flattening operation of the folded portion Sb due to the two sets of shaping grippers 409*c* to 409*f* disposed at opposite sides of the shaping roller 410 with respect to the moving direction of the shaping roller 410. This is because the set of shaping grippers 409*d* and 409*f* and the set of shaping grippers 409*c* and 409*e* nip the batch Sa in a more secure fashion at opposite sides of the folded portion Sb (the spine) being flattened by the shaping roller 410 with respect to the moving direction of the shaping roller 410.

Furthermore, in the folded-portion processing device 1400 according to the second embodiment, when a folded-portion processing unit U2 moves to the right in FIG. 12, the set of shaping grippers 409*d* and 409*f* on the right side precedes the shaping roller 410, whereas when the folded-portion processing unit U2 moves to the left, the set of shaping grippers 409*c* and 409*e* precedes the shaping roller 410. Consequently, whether the folded-portion processing unit U2 moves to the right or to the left, the shaping roller 410 is always preceded by either the set of shaping grippers 409*d* and 409*f* or the set of shaping grippers 409*c* and 409*e*. This means that the shaping roller 410 is capable of readily flattening the folded portion Sb by moving in either direction.

The second embodiment can ensure better shaping of the folded portion Sb of the batch Sa of sheets by allowing the folded-portion processing unit U2 to move back and forth several times.

In the first and second embodiments, the shaping grippers 409*a* to 409*f* for nipping the batch Sa of sheets, and the shaping roller 410 for applying a pressing force to the folded portion Sb of the batch Sa of sheets are held within the same casing 413. Consequently, by shifting the casing 413, the shaping grippers 409*a* to 409*f* and the shaping roller 410 process the folded portion Sb of the batch Sa. This means that when the folded portion Sb of the batch Sa is being flattened in response to the movement of the casing 413, the relationship between the position at which the shaping grippers 409*a* to 409*f* nip the batch Sa and the position at which the shaping roller 410 press the batch Sa is kept stable and is thus prevented from changing. Moreover, the forces applied to the batch Sa from different directions by the shaping grippers 409*a* to 409*f* and the shaping roller 410 are prevented from becoming unbalanced. Accordingly, this ensures a finely shaped folded-portion Sb of a folded batch Sa of sheets.

Figure 13:
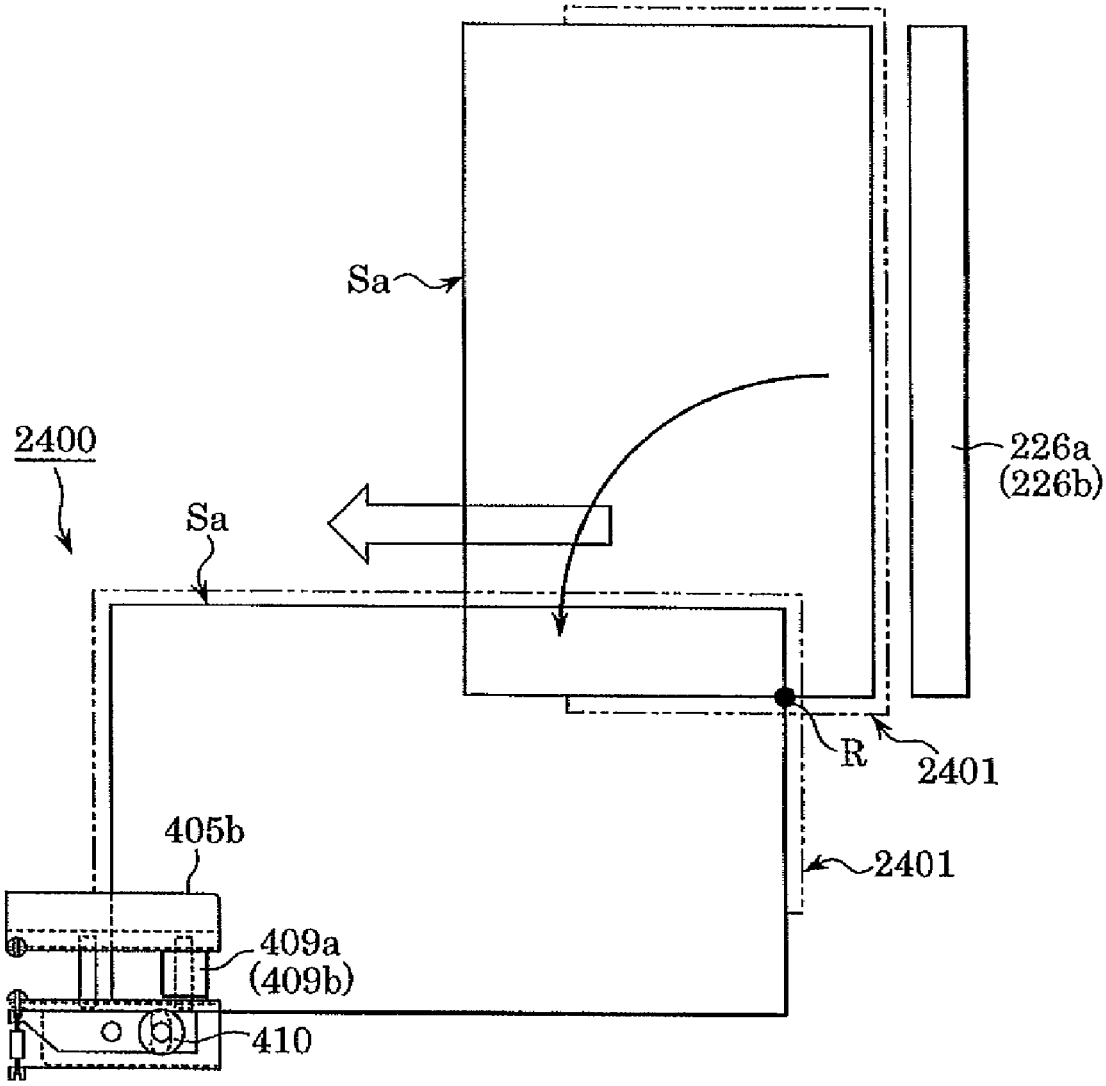
FIG. 13 is a plan view of a folded-portion processing device according to a third embodiment.
Figure 14:
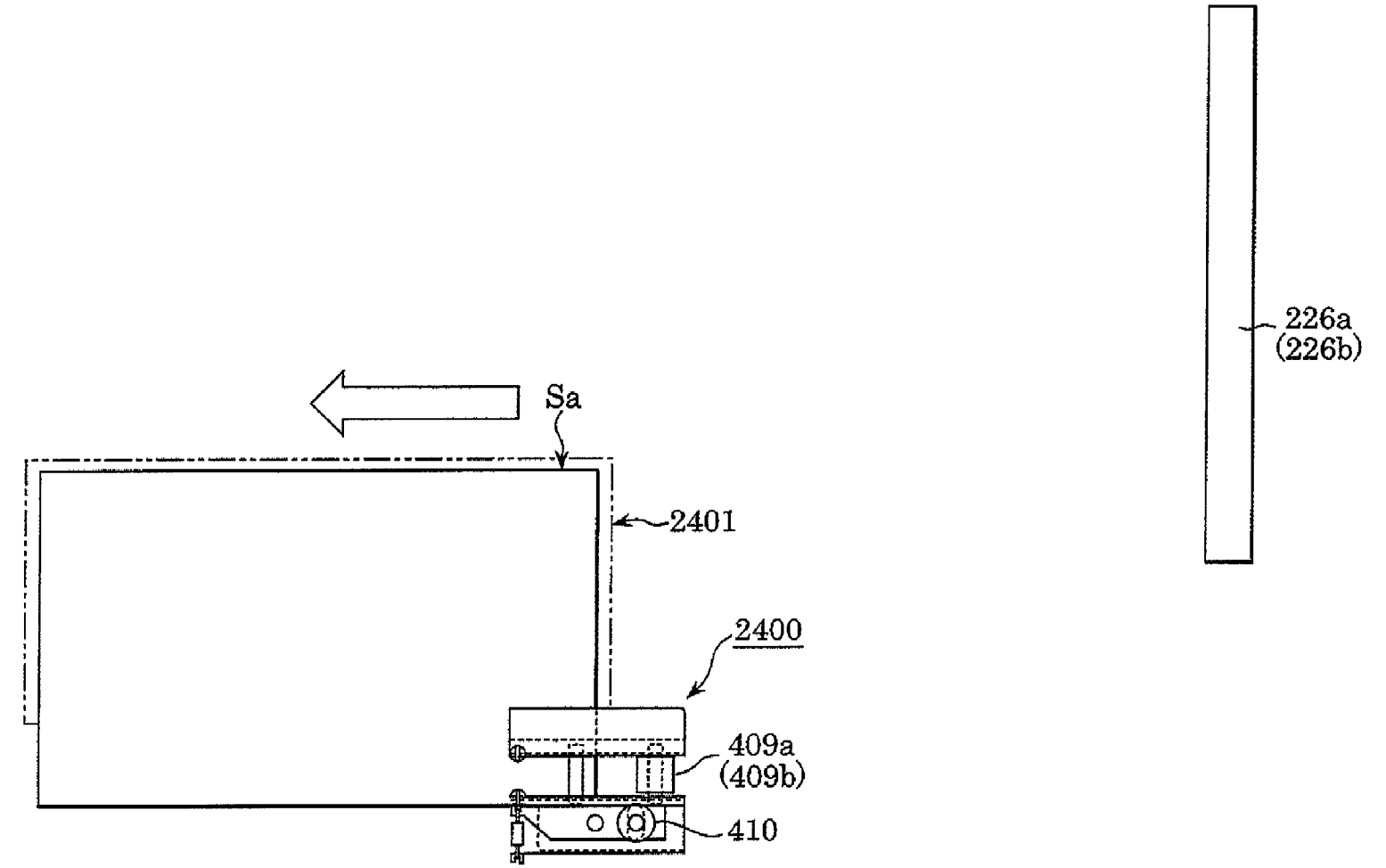
FIG. 14 illustrates a state where the flattening operation for flattening the folded portion is completed by the folded-portion processing device shown in FIG. 13.
Figure 15:
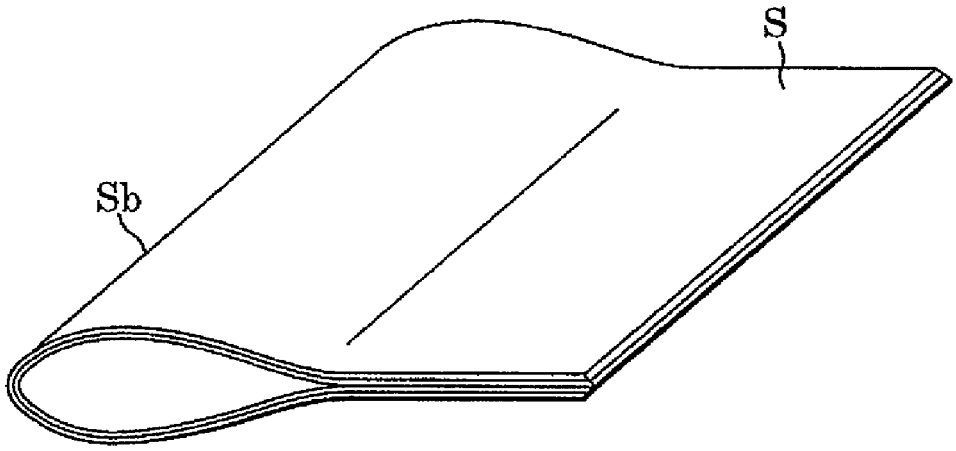
FIG. 15 is a perspective view of a folded batch of sheets having a bulging folded portion.
Figure 16:
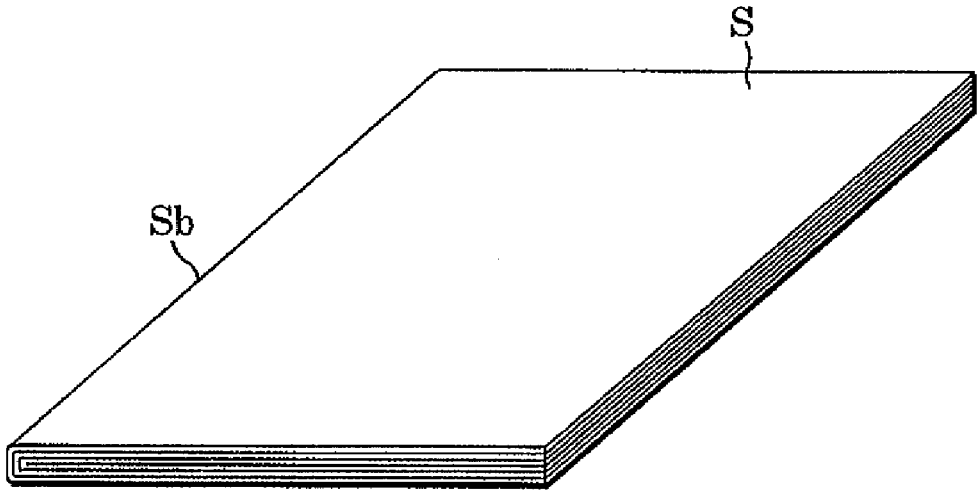
FIG. 16 is a perspective view of a folded batch of sheets having a flattened folded portion.
Figure 17A:
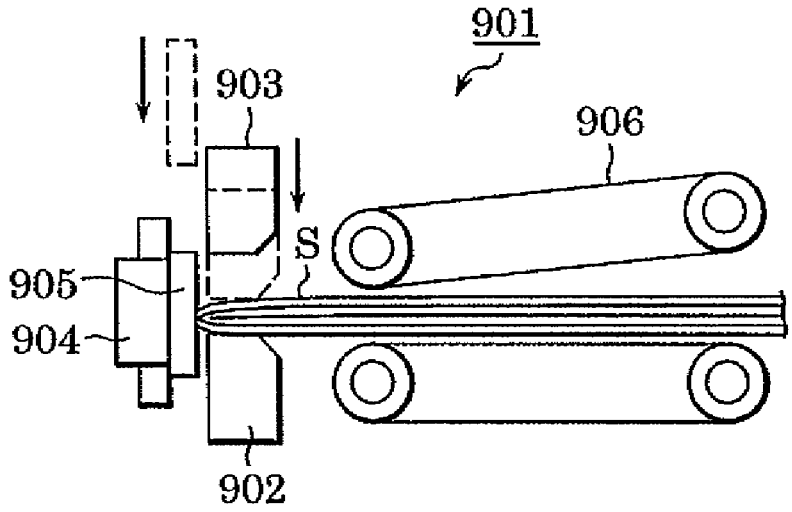
FIG. 17A PRIOR ART
FIG. 17A is a front view of a conventional sheet processor, and illustrates a state where a folded batch of sheets is received by a pair of gripping members.
Figure 17B:
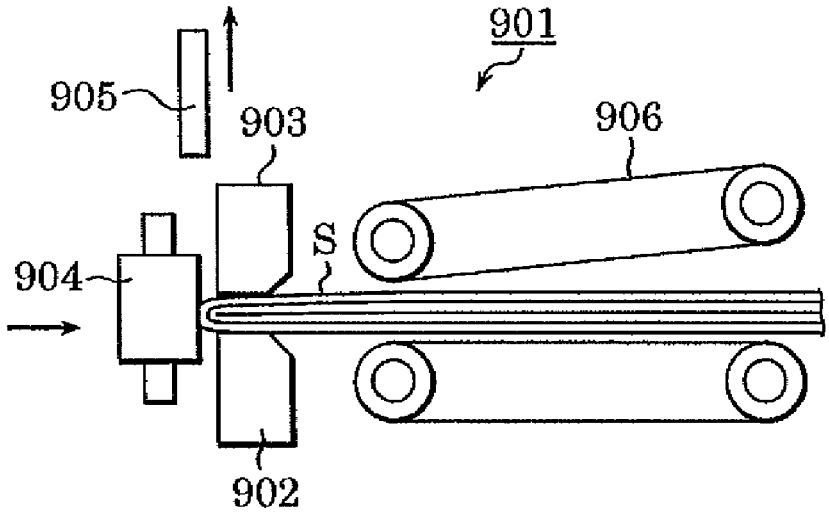
FIG. 17B PRIOR ART
FIG. 17B is another front view of the conventional sheet processor, and illustrates a state where the batch of sheets is nipped between the gripping members while the folded portion of the batch is being flattened by a pressing roller.

FIGS. 13 and 14 illustrate a folded-portion processing device 2400 according to a third embodiment. The folded-portion processing device 2400 is characterized in that the folded portion Sb (the spine) of the batch Sa is flattened by moving the batch Sa of sheets.

In the folded-portion processing device 2400, the batch Sa of sheets folded back by the set of folding rollers 226*a* and 226*b* and the pushing member 225 (not shown in FIGS. 13 and 14) is conveyed to a turning base 2401 via the folding rollers 226*a* and 226*b*. Subsequently, as shown in FIG. 13, the turning base 2401, which defines a conveying unit, rotates by about 90° around a point R so as to turn the batch Sa around by about 90°. The turning base 2401 then moves in the direction indicated by the large arrow in FIGS. 13 and 14. In the process of moving in the direction of the large arrow, the turning base 2401 allows the folded portion Sb of the batch Sa to receive the pressing force of the shaping roller 410 while the folded portion Sb passes through the gap between the upper shaping-gripper 409*a* and the lower shaping-gripper 409*b*. The folded portion Sb of the batch Sa thus becomes flat, and the batch Sa is then discharged outward onto a catch tray. The structure of the third embodiment is similar to that of the first embodiment in that the shaping roller 410 and the shaping-grippers 409*a*and 409*b* are held within the same casing 413.

Alternatively, in the folded-portion processing device 2400 according to the third embodiment, the upper shaping-gripper 409*a*, the lower shaping-gripper 409*b*, and the shaping roller 410 may be disposed in a manner such that the conveying direction of the batch Sa is parallel to the longitudinal direction of the folding rollers 226*a* and 226*b*. This structure excludes the need for turning around the batch Sa by 90°, and thus allows the folded portion Sb of the batch Sa discharged straight from the folding rollers 226*a* and 226*b* to be flattened by moving the batch Sa in the longitudinal direction of the folding rollers 226*a* and 226*b*, which is the direction perpendicular to the original conveying direction.

Accordingly, the folded-portion processing device 2400 according to the third embodiment achieves a better processing ability of the batch Sa of sheets and contributes to a higher productivity rate since the folded portion Sb (the spine) can be flattened without having to stop the movement of the batch Sa.

Furthermore, although the folded-portion processing devices 400, 1400, and 2400 according to the first, second, and third embodiments, respectively, perform a flattening operation on a folded portion of a bound batch of sheets, the same flattening operation can alternatively be performed on a folded portion of an unbound batch of sheets.

Although the shaping grippers 409*a* to 409*f* defining nipping members described above are rollers, the shaping grippers 409*a* to 409*f* do not necessarily have to be rollers. Alternatively, the shaping grippers 409*a* to 409*f* may be endless rotatable belts or spatulate components. Similarly, the shaping roller 410 defining a pressing member does not necessarily have to be a roller, and may alternatively be an endless rotatable belt or a spatulate component.

While the present invention has been described with reference to exemplary embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A sheet processor operable to process a folded batch of sheets, comprising:

a nipping member configured to nip a face portion of the folded batch of sheets;

a pressing member configured to press against a folded portion of the folded batch of sheets while the nipping member nips the face portion adjacent to the folded portion;

a casing supporting the pressing member and the nipping member; and a support member movably supporting the casing in the moving direction along the folded portion, wherein the pressing member and the nipping member are movable in a moving direction along the folded portion.

2. The sheet processor according to claim 1, wherein the nipping member nips the folded batch of sheets at a first position and the pressing member presses the folded batch of sheets at a second position behind the first position with respect to the moving direction along the folded portion.

3. The sheet processor according to claim 1, further comprising a nip-adjustment mechanism facilitating adjusting a nipping force of the nipping member.

4. The sheet processor according to claim 1, further comprising a pressure-adjustment mechanism facilitating adjusting a pressing force of the pressing member.

5. The sheet processor according to claim 1, wherein the nipping member includes a pair of rotatable rollers configured to nip the folded batch of sheets from opposite directions, and wherein the pressing member includes a rotatable roller.

6. The sheet processor according to claim 1, wherein the nipping member includes first and second pairs of rotatable rollers configured to nip the folded batch of sheets at first and second positions along the moving direction along the folded portion, respectively, and the pressing member includes a rotatable roller configured to press the folded batch of sheets at a third position between the first and second positions with respect to the moving direction along the folded portion.

7. The sheet processor according to claim 1, further comprising a holding unit configured to hold the folded batch of sheets, wherein the holding unit movably holds the folded batch of sheets in a moving direction with respect to the nipping member and the pressing member.

8. An image-forming apparatus comprising:

an image-forming unit configured to form an image on a sheet of recording medium; and the sheet processor according to claim 1 operable to process the sheet of recording medium having the image formed thereon by the image-forming unit.

9. A sheet processor operable to process a batch of sheets, comprising:

a pushing member configured to push the batch of sheets in a thickness direction of the batch of sheets;

a pair of rotatable folding components having a gap therebetween into which the pushing member pushes the batch of sheets, the pair of the rotatable folding components receiving and conveying the batch of sheets so as to fold back the batch of sheets;

a nipping member configured to nip a face portion of the folded batch of sheets folded by the pushing member and the pair of the rotatable folding components;

a pressing member configured to press against a folded portion of the folded batch of sheets while the nipping member nips the face portion adjacent to the folded portion;

a casing supporting the pressing member and the nipping member; and a support member movably supporting the casing in the moving direction along the folded portion, wherein the pressing member and the nipping member are movable in a moving direction along the folded portion.

10. The sheet processor according to claim 9, wherein the pushing member and the pair of rotatable folding components hold the batch of sheets while the pressing member presses the folded portion and the nipping member nips the folded batch of sheets.

* * * * *